US005851741A

United States Patent [19]

Takahashi et al.

[11] Patent Number: 5,851,741

[45] **Date of Patent: *Dec. 22, 1998**

[54] METHOD FOR THE FORMATION OF COLOR IMAGES

[75] Inventors: Osamu Takahashi; Hideaki Naruse; Nobuo Sakai, all of Kanagawa, Japan

[73] Assignee: Fuji Photo Film Co., Ltd., Kanagawa, Japan

[ * ] Notice: The portion of the term of this patent subsequent to Nov. 8, 2005, has been disclaimed.

[21] Appl. No.: 300,849

[22] Filed: Sep. 6, 1994

Related U.S. Application Data

[63] Continuation of Ser. No. 715,866, Jun. 17, 1991, abandoned, which is a continuation of Ser. No. 7,201, Jan. 27, 1987, abandoned.

[30] Foreign Application Priority Data

Jan. 24, 1986 [JP] Japan ..... 14546/86

[51] Int. Cl.[6] ..... G03C 7/38; G03C 7/384; G03C 7/413

[52] U.S. Cl. ..... 430/380; 430/567; 430/372; 430/376; 430/464; 430/546; 430/467; 430/505; 430/549

[58] Field of Search ..... 430/567, 372, 430/376, 464, 546, 380, 467, 505, 549

[56] References Cited

U.S. PATENT DOCUMENTS

| | | | |
|---|---|---|---|
| 3,619,195 | 11/1971 | Van Campen | 430/505 |
| 3,996,054 | 12/1976 | Santemma et al. | 430/377 |
| 4,269,927 | 5/1981 | Atwell | 430/567 |
| 4,326,022 | 4/1982 | Ito et al. | 430/546 |
| 4,385,110 | 5/1983 | Yoneyama et al. | 430/372 |
| 4,407,940 | 10/1983 | Nakamura et al. | 430/551 |
| 4,564,590 | 1/1986 | Sasaki et al. | 430/551 |
| 4,607,002 | 8/1986 | Nakayama et al. | 430/505 |
| 4,639,413 | 1/1987 | Kawagishi et al. | 430/546 |
| 4,748,100 | 5/1988 | Umemoto et al. | 430/505 |
| 4,783,394 | 11/1988 | Hirose et al. | 430/380 |
| 4,840,878 | 6/1989 | Hirose et al. | 430/380 |
| 4,857,444 | 8/1989 | Hirose et al. | 430/549 |
| 4,892,804 | 1/1990 | Vincent et al. | 430/380 |

FOREIGN PATENT DOCUMENTS

| | | |
|---|---|---|
| 0080896 | 6/1983 | European Pat. Off. . |
| 0081768 | 6/1983 | European Pat. Off. . |
| 0107488 | 5/1984 | European Pat. Off. . |
| 0112545 | 7/1984 | European Pat. Off. . |
| 0162328 | 11/1985 | European Pat. Off. . |
| 0164961 | 12/1985 | European Pat. Off. . |
| 60-158446 | 8/1985 | Japan . |

OTHER PUBLICATIONS

Hirabayashi et al., Chemical Abstract No. 104, vol. 6, No. 43122 Z.

Patent Abstracts of Japan, vol. 9 No. 308 (P–410)[2031], Dec. 4 1985; & JP–A–60 138 548 (Fuji Shashin Film K.K.), Jul. 23, 1985.

Patent Abstracts of Japan, vol. 5, No. 56 (P–57)[728], Apr. 17, 1981; & JP–A–56 11 452 (Konishiroku Shashin Kogyo K.K.), Feb. 4, 1981.

Patent Abstracts of Japan, vol. 3, No. 18 (E–91), Feb. 16, 1979, p. 71, E91; & JP–A–53 146 622, (Konishiroku Shashin Kogyo K.K.), Dec.20, 1978.

Chemical Abstracts, vol. 101, No. 20, Nov. 1984, p. 625, No. 181073y, Columbus Ohio, US; & DD–A–160 620 (VEB Filmfabrik Wolfen) Nov. 23, 1983.

*Primary Examiner*—Mark F. Huff

*Attorney, Agent, or Firm*—Sughrue, Mion, Zinn, Macpeak & Seas, PLLC

[57] ABSTRACT

The present invention provides a method for forming color images by processing in a short period of time color photographic materials containing at least one oil-soluble coupler with a color developer which does not substantially contain benzyl alcohol, wherein a silver halide color photographic material having at least one silver halide emulsion layer on a reflective support, the emulsion layer containing a dispersion of oleophilic fine grains having a mean grain size of 0.25 $\mu$m or less, which contain a coupler capable of forming a dye after having been coupled with an oxidation product of an aromatic primary amine developing agent, and at least one high boiling organic solvent having a dielectric constant of 4.00 or more (25° C., 10 KHz). The photographic material is imagewise exposed and then subjected to development with a color developer which contains an aromatic primary amine developing agent but does not substantially contain benzyl alcohol for 2 minutes and 30 seconds or less.

18 Claims, No Drawings

METHOD FOR THE FORMATION OF COLOR IMAGES

This is a continuation of application Ser. No. 07/715,866, filed Jun. 17, 1991, now abandoned, which is a continuation of application Ser. No. 07/007,201, filed Jan. 27, 1987 now abandoned.

FIELD OF THE INVENTION

The present invention relates to a method for the formation of color images on silver halide color photographic materials and, in particular, to using improved color couplers without the use of benzyl alcohol for the reduction of processing time.

BACKGROUND OF THE INVENTION

A silver halide color photographic material has a multilayer light-sensitive film, as coated on a support, comprising three kinds of silver halide emulsion layers selectively sensitized so that the layers may have a light sensitivity to blue light, green light and red light, individually. For instance, a so-called color photographic paper (hereinafter referred to as "color paper") generally has a red-sensitive emulsion layer, a green-sensitive emulsion layer and a blue-sensitive emulsion layer as coated on a support to be exposed to light and, in addition, color stain preventive or ultra-violet absorptive intermediate layers, protective layers, and the like are provided between the light-sensitive layers, and so on.

For the formation of color photographic images, photographic couplers for the three colors of yellow, magenta and cyan are incorporated into the light-sensitive layers and the photographic materials are, after having been exposed to light, subjected to color development with a so-called color developing agent. The coupling reaction between the oxidized product of an aromatic primary amine and the coupler results in the formation of colored dyes. Coupling speed in the reaction as high as possible and the couplers having higher colorability so as to obtain a higher color density within the limited developing time are desired. Moreover, the colored dyes are required to be sharp cyan, magenta, and yellow dyes, individually, with less side absorption and to form color photographic images of good color reproduceability.

On the other hand, the color photographic images as formed are required to have good preservation stability under various conditions. In order to satisfy this requirement, it is important that the discoloration or color change speed of the colored dyes of different hues is slow and that the discoloration speed is as even as possible throughout the whole range of the color image density with less variation of the color balance of the remaining color image.

In order to solve these problems, so-called oil-soluble couplers have heretofore been proposed, which are dissolved in a high boiling or low boiling organic solvent, and the resulting coupler solution is emulsified, dispersed, and incorporated into an emulsion layer. The use of such couplers, however, is accompanied by difficult problems such as the color developing agent hardly penetrating into the coupler dispersion-containing oil drops, the agent having a poor oleophilic property, and low color density. Under these circumstances, various kinds of developing agent-penetratives have been investigated. In particular, the addition of benzyl alcohol to color developers for the acceleration of the color development has heretofore been widely utilized for the processing of photographic color photographic materials, in particular, color papers, as the coloration-accelerating effect by the addition of benzyl alcohol is remarkable.

However, the use of benzyl alcohol requires diethylene glycol, triethylene glycol or alkanolamines as a solvent, since benzyl alcohol has poor water solubility. Benzyl alcohol and these solvents have high BOD and COD values, which are environmental pollution load values, and, therefore, the elimination of benzyl alcohol is preferable in view of the need to reduce the environmental pollution load.

Moreover, even when such solvents are used, the dissolution of benzyl alcohol in the solvents requires much time and, therefore, the use of benzyl alcohol is not preferred, because it is desirable to reduce the time required for preparation of photographic processing solutions.

Further, in the case where benzyl alcohol is carried over into the bleaching bath or bleach-fixing bath, which is a post-bath after the developing bath, this will result in the formation of a leuco dye of a cyan dye, causing a decrease in color density. In addition, the use of benzyl alcohol will retard the rate at which developer components are washed out, which often adversely influences the image preservation stability of photographic materials after processing. Accordingly, benzyl alcohol is preferably not used in view of the above-mentioned reasons.

Color development is, in general, completed within 3 to 4 minutes by conventional means and, recently, reduction of processing time is being required along with the reduction of the time limit for the delivery of commercial color prints and with the reduction of the development laboratory work load.

In spite of this situation, the elimination of benzyl alcohol, which is a coloration accelerator, and reduction of the developing time have not been possible without causing an inevitably noticeable deterioration of color density.

In order to solve these problems, various kinds of color development accelerators (for example, compounds as described in U.S. Pat. Nos. 2,950,970, 2,515,147, 2,496,903, 2,304,925, 4,038,075 and 4,119,462, British Patents 1,430,998 and 1,455,413, Japanese Patent Application (OPI) Nos. 15831/78, 62450/80, 62451/80, 62452/80 and 62453/80 (the term "OPI" as used herein refers to a "published unexamined Japanese patent application"), and Japanese Patent Publication Nos. 12422/76 and 49728/80) have heretofore been tried to be co-used together with color developers, but sufficient color density could not be obtained as yet.

The incorporation of 3-pyrazolidones into photographic materials (for example, as described in Japanese Patent Application (OPI) Nos. 26338/85, 158444/85 and 158446/85) still is defective in that the sensitivity of the photographic materials is lowered and fog occurs during the formation of the photographic materials.

The incorporation of color developing agents into photographic materials (for example, as described in U.S. Pat. Nos. 3,719,492, 3,342,559 and 3,342,597 and Japanese Patent Application (OPI) Nos. 6235/81, 16133/81, 97531/82 and 83565/82) also is defective in that the speed of the color development is lowered and fog occurs, and this is undesirable.

In order to overcome these problems, the use of silver chloride emulsions (for example, as described in Japanese Patent Application (OPI) Nos. 95345/83, 232342/84 and 19140/85) has been provided.

Furthermore, in the conventional method for the formation of color images wherein a reflective silver halide photographic material is processed by using a color developer which does not contain benzyl alcohol or contains little benzyl alcohol, high boiling organic solvents used as coupler solvents are as follows: dibutyl phthalate (for example, as described in Japanese Patent Application (OPI) Nos. 200037/82, 50536/83, 48755/84, 177553/84 and 162256/85, and Japanese Patent Publication No. 29461/74), dioctyl phthalate (for example, as described in Japanese Patent Application (OPI) Nos. 26338/85, 26339/85, 158446/85 and 172042/85), tricresyl phosphate (for example, as described in Japanese Patent Application (OPI) Nos. 200037/82 and 50536/83, and Japanese Patent Publication No. 29461/74), dioctylbutyl phosphate (for example, as described in Japanese Patent Application (OPI) No. 50536/83), and trioctyl phosphate (for example, as described in Japanese Patent Application (OPI) Nos. 174836/84, 177553/84 and 162256/85).

However, a method for the formation of still more sufficient color images in a still more short period of time by using color developers which do not substantially contain benzyl alcohol has not heretofore been found as yet.

SUMMARY OF THE INVENTION

Accordingly, one object of the present invention is to provide a method for the formation of color images in a short period of time by processing color photographic materials containing at least one oil-soluble coupler with color developers which do not substantially contain benzyl alcohol, and another object of the present invention is to provide a method for the formation of color images having good color reproduceability and high color image preservation stability.

The objects of the present invention can be achieved by the provision of a new method for the formation of color images, wherein a silver halide color photographic material having at least one silver halide emulsion layer on a reflective support, the emulsion layer containing a dispersion of oleophilic grains having a mean grain size of 0.25 $\mu$m or less which contain a coupler capable of forming a dye after having been coupled with an oxidation product of an aromatic primary amine developing agent, and at least one high boiling organic solvent having a dielectric constant of 4.00 or more (25° C., 10 KHz), selected from the group consisting of the following formulae (I), (II), (III), (IV) and (V):

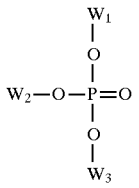
(I)

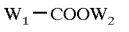
(II)

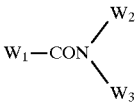
(III)

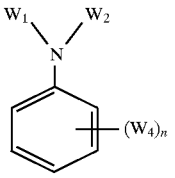
(IV)

-continued

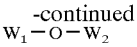
(V)

in which $W_1$, $W_2$ and $W_3$ each represents a substituted or unsubstituted alkyl, cycloalkyl, alkenyl, aryl, or heterocyclic group; $W_4$ represents $W_1$, O-$W_1$, or S-$W_1$; n represents an integer from 1 to 5 and, when n is 2 or more, each $W_4$ may be the same or different; and in the formula (V), $W_1$ and $W_2$ may be linked together to form a condensed ring; the photographic material being image-wise exposed and then subjected to development with a color developer which contains an aromatic primary amine developing agent but does not substantially contain benzyl alcohol for a period of time within 2 minutes and 30 seconds or less.

DETAILED DESCRIPTION OF THE INVENTION

In the present invention, the phrase "color developer which does not substantially contain benzyl alcohol" means that the concentration of benzyl alcohol in the color developer is 0.5 ml/l or less and, in particular, it is preferred that no benzyl alcohol is contained in the color developer.

The mean grain size is measured by dynamic light scattering photometric method. The apparatus for the measurement is, for example, Nano-Sizer by Coulter Electronics Ltd. (England).

In the above-mentioned formulae (I), (II), (III), (IV) and (V), those in which the total of the carbon atoms in $W_1$ and $W_2$ or $W_1$, $W_2$ and $W_3$ (or $W_4$) is about 8 or more have a dielectric constant of 4.00 or more (25° C., 10 KHz). The dielectric constant can easily be obtained by measuring by means of the transformer bridge method (Ando Electric Co., TRS-10T). When these $W_1$, $W_2$ and $W_3$ have substituents, the substituents may contain one or more linking groups selected from —COO—, —CON<, —$R^8$—N<, and —O—, where $R^8$ represents a divalent to hexavalent group derived from a phenyl group by removal of hydrogen atom(s) therefrom.

In the formulae (I), (II), (III), (IV) and (V), the alkyl group as represented by $W_1$, $W_2$, $W_3$ or $W_4$ may be either linear or branched, and include, for example, a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group or an eicosyl group.

Substituents for these alkyl groups are, for example, in the case of the above-mentioned formula (I), halogen atoms, cycloalkyl groups, aryl groups and ester groups, and examples of the substituted alkyl groups include:

Halogen-substituted (such as F—, Cl— or Br— substituted) groups such as —$C_2HF_4$, —$C_5H_3F_8$, —$C_9H_3F_{16}$, —$C_2H_4Cl$, —$C_3H_6Cl$, —$C_3H_5Cl_2$, —$C_3H_5ClBr$, or —$C_3H_5Br_2$;

Cycloalkyl-substituted groups such as

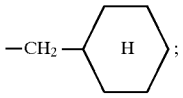
;

Aryl-substituted groups such as

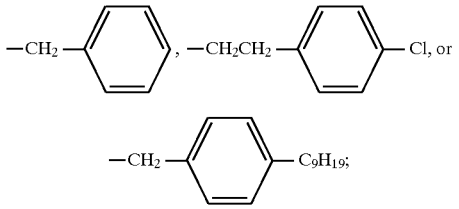

Ester-substituted groups such as

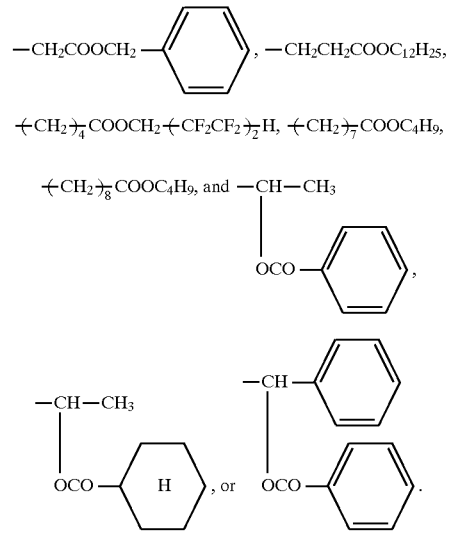

The following ester substituted groups can also be employed:

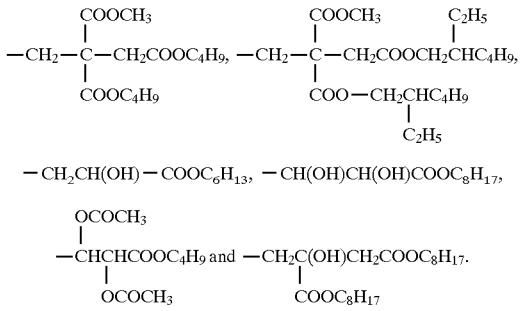

In the formulae (II) through (V), the alkyl group may be substituted by the same substituents as those in the alkyl group of the formula (I) as mentioned above.

In addition, in the formula (V), $W_1$ and $W_2$ may be linked together to form a condensed ring such as an oxirane ring, an oxolane ring or an oxane ring.

The cycloalkyl group represented by $W_1$, $W_2$, $W_3$ or $W_4$ is, for example,

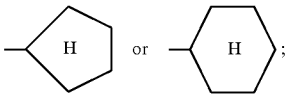

and the substituted cyclohexyl group represented by $W_1$, $W_2$, $W_3$ or $W_4$ is, for example,

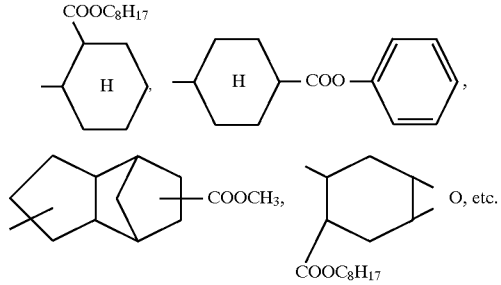

The aryl group represented by $W_1$, $W_2$, $W_3$ or $W_4$ include, for example, aromatic, substituted or unsubstituted, fused or nonfused, 6-membered rings such as

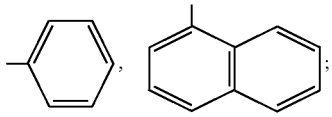

and the substituted aryl group represented by the same is, for example,

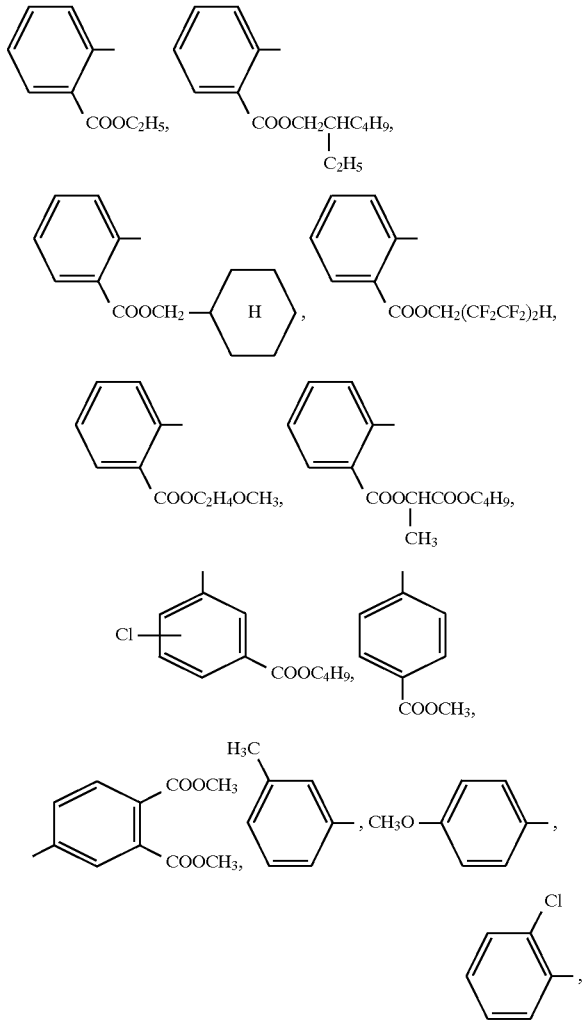

etc.

Alkenyl groups include —$C_4H_7$, —$C_5H_9$, —$C_6H_{11}$, —$C_7H_{13}$, —$C_8H_{15}$, —$C_{10}H_{19}$, —$C_{12}H_{23}$, —$C_{18}H_{35}$, etc.; and substituted alkenyl groups include, for example, those substituted by a halogen atom (e.g., F, Cl, Br), —$OC_8H_{17}$, —$OC_{12}H_{25}$,

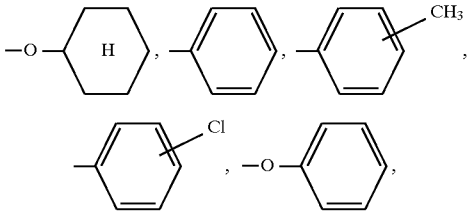

—$OCOC_8H_{17}$,

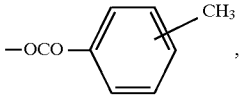

—$C_8H_{15}$, —$C_{12}H_{23}$, etc., or include

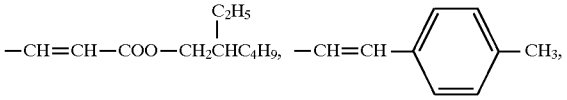

etc.

The unsubstituted or substituted heterocyclic group represented by $W_1$, $W_2$, $W_3$, or $W_4$ includes, for example,

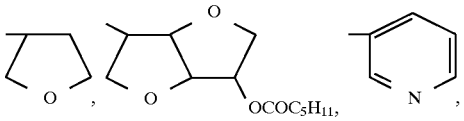

etc.

Preferably, the high boiling organic solvents as substituted by the substituents $W_1$, $W_2$, $W_3$ and/or $W_4$ have a dielectric constant of 5.00 or more at 25° C. (10 KHz) and a viscosity of 20 cp or more at 25° C. It is surprising that compounds satisfying these conditions can improve the colorability of coloring dyes without deteriorating the absorbance and other characteristics of the dyes. Though the reason for these results is not clear, it is assumed that the high boiling organic solvents having a high dielectric constant can accept a large amount of the color developing agents and those having a viscosity of 20 cp or more at 25° C. can reduce some adverse effects of the couplers and the silver halides in the oil droplets.

In the present invention, the amount of the high boiling organic solvent represented by the formula (I), (II), (III), (IV) or (V) may be any desired amount, depending upon the kinds and the amounts of the couplers used. The ratio by weight of the high boiling solvent/coupler falls, preferably, in the range of 0.05 to 20. The high boiling organic solvents of the formula (I), (II), (III), (IV) or (V) of the present invention can be used singly or in the form of a mixture of two or more of them.

Among the compounds of the formulae (I) through (V), those of the formulae (I) and (II) are preferred and, in particular, those of the formula (I) are especially preferred.

Specific examples of the high boiling organic solvents are given below, which are not whatsoever limitative.

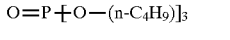

(S-1)

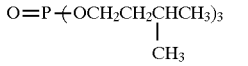

(S-2)

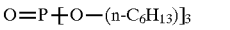

(S-3)

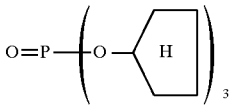

(S-4)

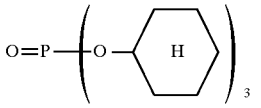

(S-5)

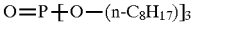

(S-6)

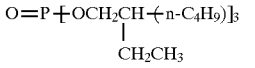

(S-7)

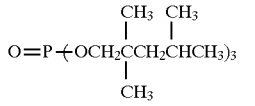

(S-8)

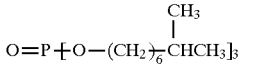

(S-9)

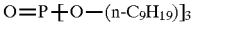

(S-10)

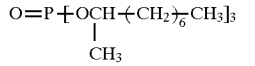

(S-11)

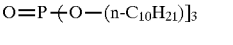

(S-12)

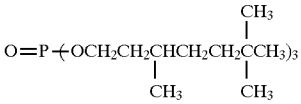

(S-13)

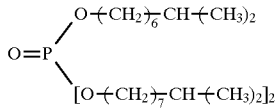

(S-14)

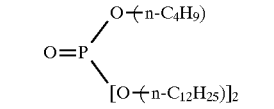

(S-15)

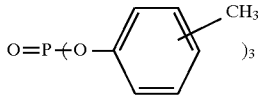

(S-16)

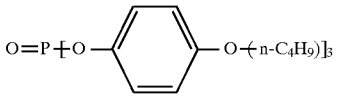

(S-17)

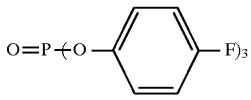

(S-18)

-continued
(S-19)
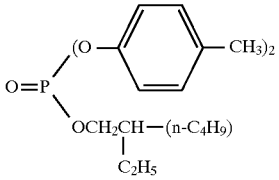
(S-20)
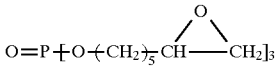
(S-21)
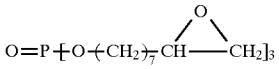
(S-22)
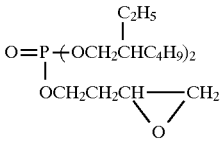
(S-23)
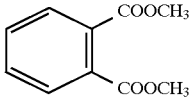
(S-24)
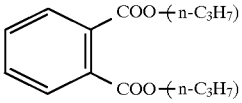
(S-25)
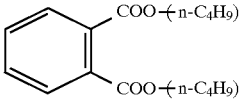
(S-26)
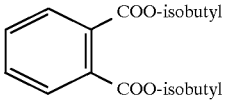
(S-27)
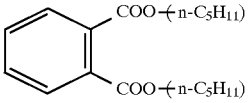
(S-28)
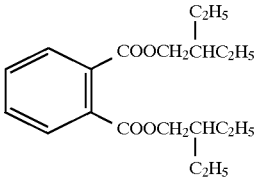
(S-29)
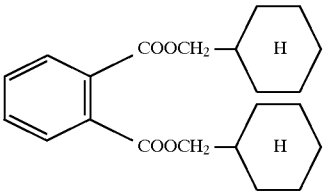
(S-30)
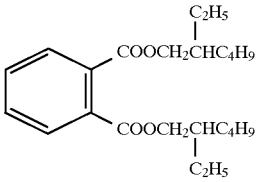
-continued
(S-31)
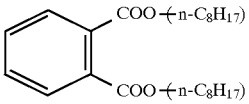
(S-32)
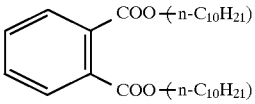
(S-33)
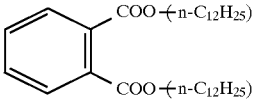
(S-34)
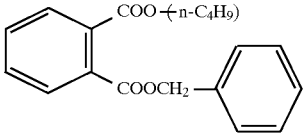
(S-35)
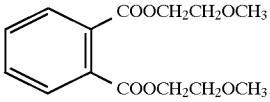
(S-36)
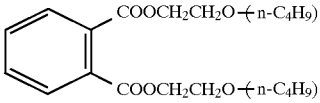
(S-37)
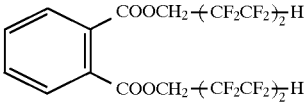
(S-38)
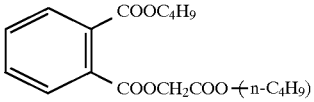
(S-39)
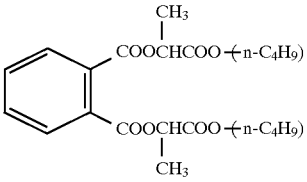
(S-40)
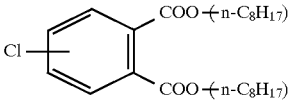
(S-41)
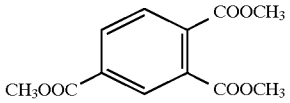
(S-42)
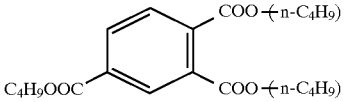
(S-43)
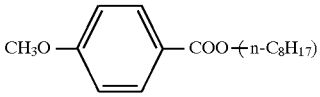

-continued
(S-44)
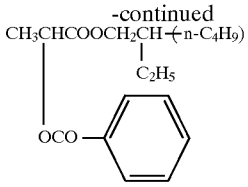
(S-45)
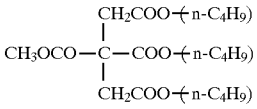
(S-46)
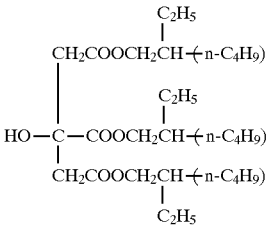
(S-47)
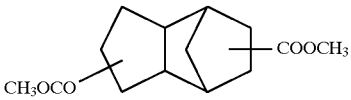
(S-48)
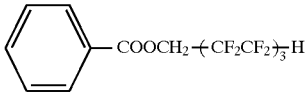
(S-49)
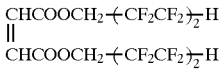
(S-50)
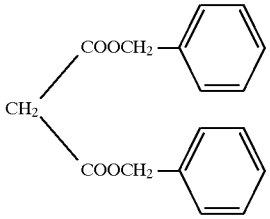
(S-51)
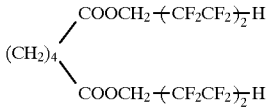
(S-52)
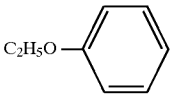
(S-53)
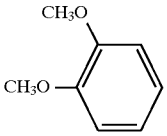
(S-54)
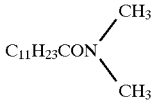
(S-55)
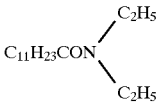
-continued
(S-56)
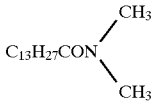
(S-57)
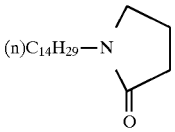
(S-58)
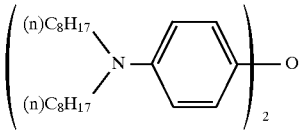
(S-59)
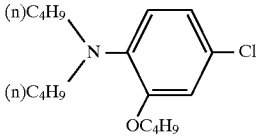
(S-60)
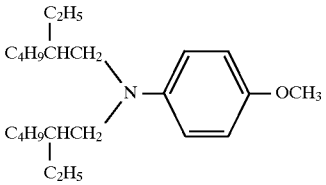
(S-61)
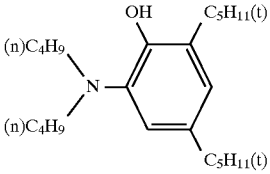
(S-62)
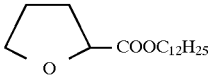
(S-63)
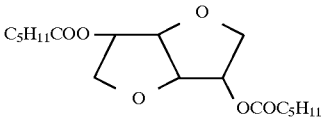
(S-64)
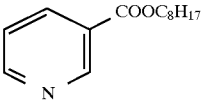
(S-65)
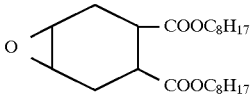
(S-66)
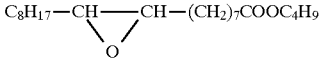
(S-67)
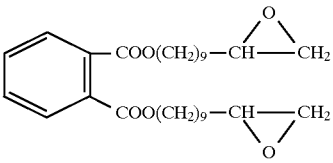
The oleophilic fine grains to be used in the present invention can be obtained, in general, by a method where a solution of the compound dissolved in a substantially water-insoluble high boiling organic solvent and a hydrophilic colloid solution are blended and dispersed. This method is described, for example, in U.S. Pat. Nos. 2,322,027, 2,533,514 and 2,801,171. If necessary, a low boiling solvent or a water-miscible organic solvent can be used, and these solvents are removed by drying evaporation or water-washing. In the case of this method, a surfactant is preferably co-used. In general, the reduction of the grain size of the above-mentioned oleophilic fine grains can be attained by the ingenuity in the apparatus or the operation, including the selection of the kinds of surfactants, the increment of the amount of the surfactant to be used, the increment of the viscosity of the hydrophilic colloid solution, the reduction of the viscosity of the organic layer in which the above-mentioned compound has been dissolved by the co-use of the low boiling solvent, the elevation of the rotation of the stirring blades in the emulsifier to reinforce the cutting force, and increasing emulsifying time. Other methods for the preparation of the oleophilic fine grain dispersion, for example, as described in U.S. Pat. No. 3,619,195, West German Patent (OAS) No. 1,957,467 and Japanese Patent Application (OPI) No. 59943/76, can also be utilized. Preferred surfactants are described, for example, in Japanese Patent Publication No. 4923/84 and U.S. Pat. No. 3,676,141.

Particularly preferred surfactants are the following compounds having an aliphatic group and a sulfonic acid group.

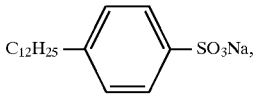

(i)

and

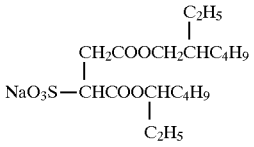

(ii)

These may be used alone or in combination thereof.

The grain size of the oleophilic fine grains of the present invention is 0.25 μm or less, preferably 0.05 μm to 0.20 μm.

The oleophilic fine grains may contain, in addition to the coupler, a discoloration inhibitor, an ultraviolet absorbent, a DIR coupler and the like oleophilic photographic elements.

The "reflective support" to be used in the present invention is one having an improved reflectivity, which has a function to improve the sharpness of the color image as formed in the silver halide emulsion layer. Examples of such reflective supports include those formed by coating a hydrophobic resin which contains a dispersion of a light-reflective substance such as titanium oxide, zinc oxide, calcium carbonate or calcium sulfate, on a support, or those made of a hydrophobic resin containing a dispersion of such light-reflective substance. For instance, baryta paper, polyethylene-coated paper, polypropylene type synthetic paper, as well as transparent supports on which a reflective layer has been provided or in which a reflective substance has been incorporated such as glass plate, polyethylene terephthalate, cellulose triacetate, cellulose nitrate and the like polyester films, and polyamide film, polycarbonate film and polystyrene film can be used. These supports can properly be selected in accordance with the use and the object of the photographic materials.

Next, the photographic processing step (image-forming step) in the present invention will be described hereunder.

The color development step in the present invention progresses rapidly: Processing time is 2 minutes and 30 seconds or less. The preferred processing time is 1 to 2 minutes. "Processing time" means the time from the first contact of the photographic material to be processed with color developer to contact of the material with the next bath, including the time for the transference of the material between the baths.

The color developer to be used in the present invention is preferably an alkaline aqueous solution mainly comprising an aromatic primary amine type color developing agent. Paraphenylenediamine type compounds are preferably used as the color developing agent and typical examples thereof are 3-methyl-4-amino-N,N-diethylaniline, 3-methyl-4-amino-N-ethyl-N-β-hydroxy-ethylaniline, 3-methyl-4-amino-N-ethyl-N-β-methane-sulfonamidoethylaniline, 3-methyl-4-amino-N-ethyl-N-β-methoxyethylaniline and sulfates, hydrochlorides, phosphates, p-toluenesulfonates, tetraphenyl borates and p-(t-octyl)benzenesulfonates thereof. Among these, 3-methyl-4-amino-N-ethyl-N-β-hydroxyethylaniline, and 3-methyl-4-amino-N-ethyl-N-β-methanesulfonamidoethylaniline, are preferred, and in particular, 3-methyl-4-amino-N-ethyl-N-β-methanesulfonamidoethylaniline, is especially preferred.

Aminophenyl type derivatives include, for example, o-aminophenol, p-aminophenol, 4-amino-2-methylphenol, 2-amino-3-methylphenol, 2-hydroxy-3-amino-1,4-dimethylbenzene, etc.

In addition, compounds as described in L. F. A. Mason, *Photographic Processing Chemistry*, pp. 226 to 229 (Focal Press), U.S. Pat. Nos. 2,193,015 and 2,592,364, and Japanese Patent Application (OPI) No. 64933/73 can also be used. If necessary, two or more color developing agents can be used in combination.

The processing temperature of the color developer of the present invention is preferably 30° to 50° C., more preferably 33° to 45° C.

As the development accelerator, any compounds can be used so far as these do not substantially contain benzyl alcohol. For instance, various kinds of pyridinium compounds and other cationic compounds, cationic dyes such as phenosafranine, neutral salts such as thallium nitrate and potassium nitrate, as described in U.S. Pat. No. 2,648,604, Japanese Patent Publication No. 9503/69 and U.S. Pat. No. 3,171,247; nonionic compounds such as polyethylene glycol and derivatives thereof and polythioethers, as described in Japanese Patent Publication No. 9304/69, U.S. Pat. Nos. 2,533,990, 2,531,832, 2,950,970 and 2,577,127; thioether type compounds as described in U.S. Pat. No. 3,201,242; and compounds as described in Japanese Patent Application (OPI) Nos. 156934/83 and 220344/85 can be mentioned.

In the short time development of the present invention, not only the means for the acceleration of the development but also the technique for the prevention of the development fog is an important subject.

A fog inhibitor may be used in the color developer of the present invention. Alkali metal halides such as potassium bromide, sodium bromide and potassium iodide and organic fog inhibitors are preferably used as the fog inhibitor in the present invention. Examples of usable organic fog inhibitors are nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine; mercapto-substituted heterocyclic compounds such as 1-phenyl-5-mercaptotetrazole, 2-mercaptobenzimidazole, 2-mercaptobenzothiazole; and, additionally, mercapto-substituted aromatic compounds such as thiosalicylic acid. In particular, the halides are especially preferred. The fog inhibitor can be dissolved out from the color photographic material, while the material is being processed, to be deposited in the color developer solution.

The color developer of the present invention may further contain a pH buffer such as alkali metal carbonates, borates or phosphates; a preservative such as hydroxylamines, triethanolamines, compounds as described in West German Patent Application (OLS) No. 2,622,950, sulfites or bisulfites; an organic solvent such as diethylene glycol; a dye-forming coupler; a competing coupler; a nucleating agent such as sodium borohydride; an auxiliary developing agent such as 1-phenyl-3-pyrazolidone; a tackifier; and a chelating agent such as aminopolycarboxylic acids, e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and compounds as described in Japanese Patent Application (OPI) No. 195845/83, 1-hydroxyethylidene-1,1'-diphosphonic acid, organic phosphonic acids as described in *Research Disclosure*, RD No. 18170 (May, 1979), aminophosphonic acids, e.g., aminotris(methylenephosphonic acid) and ethylenediamine-N,N,N',N'-tetramethylenephosphonic acid and phosphonocarboxylic acids as described in Japanese Patent Application (OPI) Nos. 102726/77, 42730/78, 121127/79, 4024/80, 4025/80, 126241/80, 65955/80 and 65956/80 and *Research Disclosure*, RD No. 18170 (May, 1979).

If necessary, the color development line may comprise two or more color developer baths and a color developer replenisher can be replenished in the first prebath or in the last postbath whereby the development time can be reduced and the amount of the replenisher may be reduced.

The silver halide color photographic materials are, after having been color-developed, generally bleached. The bleaching can be carried out simultaneously with fixation (bleach-fixing) or, alternatively, separately therefrom. As the bleaching agent there can be used, for example, compounds of polyvalent metals such as iron (III), cobalt (III), chromium (VI) or copper (II), peracids, quinones and nitroso compounds. For instance, ferricyanides, bichromates, organic complexes with iron (III) or cobalt (III) such as complexes of ethylenediaminetetraacetic acid, diethylenetriaminepentaacetic acid, nitrilotriacetic acid, 1,3-diamino-2-propanoltetraacetic acid or the like aminopolycarboxylic acid or with citric acid, tartaric acid, malic acid or the like organic acid; persulfates; manganates; and nitrosophenol can be used. In particular, potassium ferricyanide, sodium ethylenediaminetetraacetate/iron (III), ammonium ethylenediaminetetraacetate/iron (III), ammonium triethylenetetraminepentaacetate/iron (III) and persulfates are especially preferred. Ethylenediaminetetraacetate/iron (III) complexes are usable both in an independent bleaching solution and in a combined bleach-fixing solution.

The bleaching solution and the bleach-fixing solution may contain, if necessary, various kinds of accelerators. For instance, a bromide ion, an iodide ion, as well as thiourea type compounds as described in U.S. Pat. No. 3,706,561, Japanese Patent Publication Nos. 8506/70 and 26586/74, Japanese Patent Application (OPI) Nos. 32735/78, 36233/78 and 37016/78; thiol type compounds as described in Japanese Patent Application (OPI) Nos. 124424/78, 95631/78, 57831/78, 32736/78, 65732/78 and 52534/79 and U.S. Pat. No. 3,893,858; heterocyclic compounds as described in Japanese Patent Application (OPI) Nos. 59644/74, 140129/75, 28426/78, 141623/78, 104232/78 and 35727/79; thioether type compounds as described in Japanese Patent Application (OPI) Nos. 20832/77, 25064/80 and 26506/80; quaternary amines as described in Japanese Patent Application (OPI) No. 84440/73; and thiocarbamoyl type compounds as described in Japanese Patent Application (OPI) No. 42349/74 can be used.

As the fixing agents can be mentioned thiosulfates, thiocyanates, thioether type compounds, thioureas, and a large amount of iodides. In particular, thiosulfates are generally used. As the preservative for the bleach-fixing solution or the fixing solution, sulfites or bisulfites or carbonylbisulfuric acid adducts are preferred.

After the bleach-fixing or the fixing, the photographic materials are generally rinsed. In the rinsing step, various kinds of known compounds can be used for the purpose of the prevention of precipitation or of the economization of water. For instance, a hard water softener such as inorganic phosphoric acids, aminopolycarboxylic acids or organic phosphoric acids; a bactericide or fungicide for the prevention of growth of various bacteria, algae or fungi; a hardener such as magnesium salts or aluminum salts; a surfactant for the prevention of drying load or unevenness, etc., can be added in need thereof. As the case may be, compounds as described in L. E. West, *Photographic Science and Engineering*, Vol. 9, No. 6 (1965) can be added. In particular, the addition of the chelating agent or fungicide is effective. A multistage (e.g., two-stage to five-stage) countercurrent flow system can be applied to the rinsing step for the purpose of the economization of water.

After the rinsing step or in place of the rinsing step, the photographic material may be subjected to multistage countercurrent stabilization system as described in Japanese Patent Application (OPI) No. 8543/82. This step requires a countercurrent system bath line comprising two to nine baths. Various kinds of compounds are added to the stabilization baths for the stabilization of images. For instance, a pH-regulating buffer (such as borates, metaborates, borax, phosphates, carbonates, potassium hydroxide, sodium hydroxide, aqueous ammonia, monocarboxylic acids, dicarboxylic acids, polycarboxylic acids, etc.) and formalin can be added. In addition, a hard water softener (such as inorganic phosphoric acids, aminopolycarboxylic acids, organic phosphoric acids, aminopolyphosphonic acids, phosphonocarboxylic acids, etc.), a bactericide (such as Proxel, isothiazolone, 4-thiazolylbenzimidazole, halogenated phenol-benzotriazoles, etc.), a surfactant, a fluorescent whitener, a hardener, etc., can further be added in need thereof.

Various kinds of ammonium salts such as ammonium chloride, ammonium nitrate, ammonium sulfate, ammonium phosphate, ammonium sulfite, or ammonium thiosulfate can be added as a film pH-regulator for regulating the pH value of the film after processing.

The color coupler to be incorporated in the photographic materials preferably has a ballast group or is polymerized to be nondiffusible. 2-Equivalent color couplers where the coupling active positions are substituted by coupling off groups are preferred to 4-equivalent color couplers having hydrogen atoms in the coupling active positions, since the amount of the silver to be coated can be reduced. Further, couplers to form colored dyes with pertinent diffusibility, non-coloring couplers, DIR couplers to release a development inhibitor in the coupling reaction, and couplers to release a development accelerator in the coupling reaction can also be used.

Typical examples of yellow couplers which can be used in the present invention are oil-protected acylacetamide type couplers. Specific examples thereof are described in U.S.

Pat. Nos. 2,407,210, 2,875,057 and 3,265,506. In the present invention, 2-equivalent yellow couplers are preferably used, and typical examples thereof are oxygen atom-coupling off type yellow couplers as described in U.S. Pat. Nos. 3,408,194, 3,447,928, 3,933,501 and 4,022,620 and nitrogen atom-coupling off type yellow couplers as described in Japanese Patent Publication No. 10739/83, U.S. Pat. Nos. 4,401,752 and 4,326,024, *Research Disclosure*, RD No. 18053 (April, 1979), British Patent 1,425,020 and West German Patent Application (OLS) Nos. 2,219,917, 2,261,361, 2,329,587 and 2,433,812. α-Pivaloylacetanilide type couplers are excellent in fastness, especially to light, of the colored dyes. On the other hand, α-benzoylacetanilide type couplers are excellent in producing high color density.

Magenta couplers which can be used in the present invention include oil-protected indazolone type or cyanoacetyl type couplers, preferably 5-pyrazolone type couplers and pyrazoloazole type couplers such as pyrazolotriazoles. Among the 5-pyrazolone type couplers, those whose 3-position is substituted by an arylamino group or an acylamino group are preferred in view of the hue and the color density of the colored dyes. Typical examples of these couplers are described in U.S. Pat. Nos. 2,311,082, 2,343,703, 2,600,788, 2,908,573, 3,062,653, 3,152,896 and 3,936,015. Regarding the coupling off groups of the 2-equivalent 5-pyrazolone type couplers, nitrogen atom-coupling off groups as described in U.S. Pat. No. 4,310,619 and arylthio groups as described in U.S. Pat. No. 4,351,897 are especially preferred. In addition, ballast group-containing 5-pyrazolone type couplers as described in European Patent 73,636 are preferred, as forming color images of high color density.

Pyrazoloazole type couplers which can be used in the present invention include pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure*, RD No. 24220 (June, 1984) and pyrazolopyrazoles as described in *Research Disclosure*, RD No. 24230 (June, 1984). In particular, imidazo[1,2-b]pyrazoles as described in European Patent 119,741 are preferred because the yellow side absorption of the dyes formed is small and the light fastness thereof is high, and especially, pyrazolo[1,5-b][1,2,4]triazoles as described in European Patent 119,860 are particularly preferred.

Cyan couplers which can be used in the present invention are oil-protected naphthol type and phenol type couplers. Typical examples thereof are naphthol type couplers as described in U.S. Pat. No. 2,474,293, preferably oxygen atom-coupling off type 2-equivalent naphthol type couplers as described in U.S. Pat. Nos. 4,052,212, 4,146,396, 4,228,233 and 4,296,200. Specific examples of phenol type couplers are described in U.S. Pat. Nos. 2,369,929, 2,801,171, 2,772,162 and 2,895,826. Cyan couplers which are fast to moisture and temperature are preferably used in the present invention, and typical examples thereof are phenol type cyan couplers where the phenol nucleus has ethyl or a higher alkyl group in the m-position as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729 and Japanese Patent Application (OPI) No. 166956/84; and phenol type couplers having 2-ureido group and 5-acylamino group as described in U.S. Pat. Nos. 3,446,622, 4,333,999, 4,451,559 and 4,427,767.

The graininess can be improved by the incorporation of a coupler capable of forming a colored dye with appropriate diffusibility. Such dye-diffusible couplers are magenta couplers as described in U.S. Pat. No. 4,366,237 and British Patent 2,125,570 and yellow, magenta or cyan couplers as described in European Patent 96,570 and West German Patent Application (OLS) No. 3,234,533.

The dye-forming couplers and the above-mentioned special couplers may be in the form of a diner or more polymer. Typical examples of the polymerized dye-forming couplers are described in U.S. Pat. Nos. 3,451,820 and 4,080,211. Specific examples of polymerized magenta couplers are described in British Patent 2,102,173 and U.S. Pat. No. 4,367,282.

Regarding the incorporation of the couplers in the photographic materials of the present invention, two or more kinds of the couplers can be incorporated in the same layer of the light-sensitive layer, or the same compound can be incorporated in two or more different layers, in order that the photographic material can have the necessary characteristics.

The standard amount of the color coupler to be used is within 0.001 to 1 mol per mol of the light-sensitive silver halide, and preferably the amount of the yellow coupler is 0.1 to 0.5 mol, that of the magenta coupler is 0.003 to 0.3 mol and that of the cyan coupler is 0.002 to 0.3 mol each per mol of the silver halide.

The photographic light-sensitive material used in the present invention can contain hydroquinone derivatives, aminophenol derivatives, amines, gallic acid derivatives, catechol derivatives, ascorbic acid derivatives, non-coloring couplers, sulfonamidophenol derivatives, etc., as a color fog inhibitor or color stain preventing agent.

The photographic light-sensitive materials used in the present invention can contain a known discoloration inhibitor. Typical examples of usable organic discoloration inhibitors are hindered phenols such as hydroquinones, 6-hydroxychromans, 5-hydroxycoumarans, spirochromans, p-alkoxyphenols and bisphenols, and gallic acid derivatives, methylenedioxybenzenes, aminophenols, hindered amines, as well as ether and ester derivatives thereof where the phenolic hydroxyl group is silylated or alkylated. In addition, metal complexes such as (bissalicylaldoximato) nickel complexes and (bis-N,N-dialkyldithiocarbamato) nickel complexes can also be used.

Compounds having both partial structures of hindered amine and hindered phenol in one molecule as described in U.S. Pat. No. 4,268,593 are effective for the prevention of the deterioration of the yellow-colored images under heat, moisture and light. Spiroindanes as described in Japanese Patent Application (OPI) No. 159644/81 and hydroquinone-diether- or hydroquinonemonoether-substituted chromans are effective for the prevention of the deterioration of the magenta-colored images, especially under light.

Benzotriazole type ultraviolet absorbents are preferably used for improving preservation stability, especially light fastness, of the cyan-colored images. The ultraviolet absorbent can be co-emulsified with the cyan coupler.

The amount of the ultraviolet absorbent to be coated is enough to be satisfactory for imparting the light stability to the cyan-colored images. If, however, the amount is too large, the non-exposed part (white background part) of the color photographic material will be yellowed and, therefore, the amount is, in general, preferably to fall within the range of $1\times10^{-4}$ mol/m$^2$ to $2\times10^{-3}$ mol/m$^2$, especially $5\times10^{-4}$ mol/m$^2$ to $1.5\times10^{-3}$ mol/m$^2$.

In the construction of the light-sensitive layer of general color papers, the ultraviolet absorbent is incorporated into either one, preferably both, of the layers as adjacent to the both sides of the cyan coupler-containing red-sensitive emulsion layer. When the ultraviolet absorbent is added to the intermediate layer between the green-sensitive layer and the red-sensitive layer, this may be co-emulsified with the color stain preventing agent. When the ultraviolet absorbent is added to the protective layer, another protective layer can be provided as an outermost layer. The protective layer can contain a matting agent or the like, having any desired grain size.

The photographic light-sensitive materials used in the present invention can contain the ultraviolet absorbent in the hydrophilic colloid layer.

The photographic light-sensitive materials used in the present invention can contain a water-soluble dye in the hydrophilic colloid layer as a filter dye or for irradiation prevention or halation prevention or for other various purposes.

The photographic light-sensitive materials used in the present invention can contain a whitening agent such as stilbene type, triazine type, oxazole type, coumarin type or the like compounds in the photographic emulsion layers or in other hydrophilic colloid layers. The whitening agents to be used may be water-soluble or, as the case may be, water-insoluble whitening agents can be used in the form of a dispersion thereof.

As mentioned above, the present invention can be adopted to multilayer and multicolor photographic materials having at least two layers of different spectral sensitivities on a support. Multilayer natural color photographic materials have, in general, at least one red-sensitive emulsion layer, at least one green-sensitive emulsion layer and at least one blue-sensitive emulsion layer on a support. The order of these layers to be provided on the support can be selected freely in need thereof. Each of the emulsion layers may comprise two or more layers having different degrees of sensitivity or a light-insensitive layer may be provided between two or more layers having the same color sensitivity.

The photographic light-sensitive materials used in the present invention preferably have auxiliary layers such as a protective layer, intermediate layer, filter layer, antihalation layer and backing layer, in addition to the silver halide emulsion layers, when needed.

Gelatin is advantageously used as the binder or protective colloid to be incorporated into the emulsion layer or intermediate layer of the photographic light-sensitive materials of the present invention, and other hydrophilic colloids can, of course, be used.

For instance, proteins such as gelatin derivatives, graft polymers of gelatin, and other high molecular weight substances, protein such as albumin, casein, etc.; cellulose derivatives such as hydroxyethyl cellulose, carboxymethyl cellulose, cellulose sulfates, etc.; saccharide derivatives such as sodium alginate, starch derivatives, etc.; mono- co copolymers and the like of various synthetic hydrophilic high molecular weight substances such as polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc., can be used.

Gelatins which can be used in the present invention include lime-treated gelatin, acid-treated gelatin and enzyme-treated gelatin as described in *Bull. Soc. Sci. Phot. Japan*, No. 16, page 30 (1966); and in addition, hydrolyzed or enzyme-decomposed products of gelatins can also be used.

The photographic light-sensitive materials used in the present invention can further contain, in addition to the above-mentioned additives, various kinds of stabilizers, stain inhibitors, developing agents or precursors thereof, lubricants, mordants, matting agents, antistatic agents, plasticizers and other various kinds of additives which are useful for photographic light-sensitive materials. Typical examples of these additives are described in *Research Disclosure*, RD Nos. 17643 (December, 1978) and 18716 (November, 1979).

The silver halide emulsions which can be used in the present invention are those of silver bromide, silver chlorobromide and silver chloride which are substantially free from any silver iodide; and preferred silver halides are silver chlorobromide containing 20 to 98 mol % of silver bromide.

Particularly, to still more rapid processing, silver chlorobromide containing more than 80 mol % of silver chloride is preferably used.

The silver halide grains to be used in the present invention may comprise different inner and surface layer phases, or may have a multiphase constitution with epitaxial structure, or otherwise, may have a wholly uniform phase. Further, the present grains may comprise a combination of these structures.

The average grain size of the silver halide grains to be used in the present invention is preferably 0.1 $\mu$m to 2 $\mu$m, especially preferably 0.15 $\mu$m to 1 $\mu$m. (The grain size is the grain diameter in the case of spherical or nearly spherical grains or is the side length in the case of cubic grains, and the average grain size is represented on the basis of the mean value of the projected area of the grains.) The grain size distribution may be either narrow or broad. In particular, a so-called monodispersed silver halide emulsion is preferably used in the present invention, where the value of the standard deviation in the grain size distribution curve of the silver halide emulsion as divided by the average grain size thereof (or, that is, coefficient of variation) can fall within 20% or less, especially preferably 15% or less. In order to satisfy the desired gradation of the photographic light-sensitive materials, two or more monodispersed silver halide emulsions (where the monodispersed system preferably has the above-defined variation coefficient) having substantially the same color sensitivity but having different grain size distributions can be incorporated in the same layer or into plural different layers as laminated. Further, two or more kinds of polydispersed silver halide emulsions or a combination of monodispersed emulsion and polydispersed emulsion can be used in mixture or in laminate.

The shape of the silver halide grains to be used in the present invention may be a cubic, octahedral, dodecahedral, tetradecahedral or the like regular crystal, or may be a spherical or the like irregular crystal or, otherwise, the present grains may comprise composite forms of these crystal shapes. A cubic, tetradecahedral or the like regular crystal grains are preferably used. Further, the present grains may be tabular and, in particular, an emulsion where 50% or more of the total projected area of the grains comprises tabular grains having an aspect ratio (length/thickness) of 5 or more, especially 8 or more, can be used in the present invention. An emulsion comprising a mixture of these various kinds of crystal forms can, of course, be used. These various kinds of emulsions may belong to either a surface latent image type where a latent image is formed essentially on the surface of the grains or an internal latent image type where a latent image is formed essentially in the inner part of the grains. The surface latent image type silver halide emulsion is preferably used in the present invention. In particular, the silver halide emulsion layer preferably contains a silver halide emulsion which predominately forms a latent image on the surface thereof upon exposure to light.

The photographic emulsions to be used in the present invention can be prepared by a variety of methods, for example, as described in P. Glafkides, *Chimie et Physique Photographique* (Paul Montel Co., 1967), G. F. Duffin, *Photographic Emulsion Chemistry* (Focal Press Co., 1966) and V. L. Zelikman et al., *Making and Coating Photographic Emulsion* (Focal Press Co., 1964). For instance, the present emulsions can be obtained by any of an acidic method, a neutral method, or an ammonia method; and for the reaction of a soluble silver salt and a soluble halide, a single jet method, a double jet method or a combination thereof can be utilized. A so-called reverse mixing method where the grains are formed in the presence of excess silver ions can also be utilized. Further, a so-called controlled double jet method which is one type of the double jet method can also be utilized, where the pAg value in the liquid phase to form the silver halide grains is kept constant. According to this method, silver halide emulsions having a regular crystalline form and a nearly uniform grain size can be obtained.

In addition, emulsions as prepared by a conversion method comprising a step for converting the already formed silver halide grains into those having a smaller solubility product during the procedure up to the completion of the formation of the silver halide grains, or emulsions as prepared by a method where the same halogen conversion is applied to the already formed grains after completion of the formation of the grains, can also be used.

A cadmium salt, a zinc salt, a lead salt, a thallium salt, an iridium salt or a complex thereof, a rhodium salt or a complex thereof, an iron salt or a complex thereof or the like can exist for preventing the reciprocity law failure, increasing the sensitivity, controlling the gradation, etc., in the step for the formation of the silver halide grains or the physical ripening thereof.

The silver halide grains are generally subjected to physical ripening, demineralization or chemical ripening, after the formation thereof, and then coated on a support.

Known silver halide solvents (for example, ammonia, rhodankali or thioethers and thione compounds as described in U.S. Pat. No. 3,271,157 and Japanese Patent Application (OPI) Nos. 12360/76, 82408/78, 144319/78, 100717/79 and 155828/79) can be used in precipitation, physical ripening and chemical ripening. The removal of soluble silver salts from the physically ripened emulsions can be carried out by noodle washing, flocculation precipitation or ultrafiltration.

The silver halide emulsions to be used in the present invention can be sensitized by a sulfur sensitization method where a sulfur-containing compound capable of reacting with an active gelatin or silver (for example, thiosulfates, thioureas, mercapto compounds and rhodanines) is used; a reductive sensitization method where a reducing substance (for example, stannous salts, amines, hydrazine derivatives, formamidine sulfinic acid, silane compounds) is used; or a noble metal sensitization method where a metal compound (for example, gold complexes as well as complexes of the Periodic Table VIII group metals such as Pt, Ir, Pd, Rh, Fe) is used; and these sensitization methods can be utilized singly or in the form of a combination thereof.

Among these chemical sensitization methods, the single sulfur sensitization is more preferred.

Each of the blue-sensitive, green-sensitive and red-sensitive emulsions of the present invention are spectrally sensitized with methine dyes or the like other dyes so as to have the respective color sensitivity. Usable dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are those belonging to cyanine dyes, merocyanine dyes and complex merocyanine dyes. Any and every basic heterocyclic nucleus which may generally be contained in cyanine dyes may be applied to these dyes. For instance, such nuclei include pyrroline, oxazoline, thiazoline, pyrrole, oxazole, thiazole, selenazole, imidazole, tetrazole, pyridine nuclei, etc.; alicyclic hydrocarbon ring-fused heterocyclic nuclei; and aromatic hydrocarbon ring-fused heterocyclic nuclei such as indolenine, benzindolenine, indole, benzoxazole, naphthoxazole, benzothiazole, naphthothiazole, benzoselenazole, benzimidazole, quinoline nuclei, etc. These nuclei may be substituted on their carbon atoms.

Merocyanine dyes and complex merocyanine dyes may contain a ketomethylene structure-containing 5- or 6-membered heterocyclic nucleus, such as pyrazolin-5-one, thiohydantoin, 2-thiooxazolidine-2,4-dione, thiazolidine-2, 4-dione, rhodanine or thiobarbituric acid nucleus.

These sensitizing dyes can be used singly or in the form of a mixture thereof, and the combination of the sensitizing dyes is often utilized for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, and Japanese Patent Application (OPI) Nos. 110618/77 and 109925/77.

Dyes which themselves have no spectral sensitization activity or substances which do not substantially absorb visible rays but have a supersensitization activity can be incorporated into the emulsions together with the sensitizing dyes.

The present invention will be explained in greater detail by reference to the following examples which, however, are not intended to be interpreted as limiting the scope of the present invention.

EXAMPLE 1

35 ml of ethyl acetate and 12 ml of Comparative Compound A (dielectric constant: 3.61) were added to 24.0 g of Yellow Coupler (Y-1) and dissolved, and the resulting solution was added to 160 ml of a 12% gelatin aqueous solution containing 12 ml of 10% sodium dodecylbenzenesulfonate, and emulsified and dispersed with a high speed stirrer to obtain an emulsified dispersion containing dispersed grains having a mean grain diameter of 0.46 $\mu$m. (The grain size was measured by the use of Nano-Sizer (by Coulter Electronics Ltd., England), which is a grain size measuring apparatus with laser ray-scattering.) The total amount of the resulting dispersion was added to a silver chlorobromide emulsion comprising 80% of Br (Ag content: 70 g/kg), and the resulting emulsion was coated on a paper support laminated both sides thereof with polyethylene, the coated Ag amount being 0.31 g/m$^2$, and a gelatin layer was provided over the thus coated layer to obtain Sample No. 1. Sodium 1-hydroxy-3,5-dichloro-s-triazine was used as the gelatin hardener.

Next, other emulsified dispersions as shown in the following Table 1 were prepared in the same manner as above, with the exception that the compound as shown below was used in place of Comparative Compound A and that the emulsification conditions were varied (by the variation of the rotation number of the stirring blades in emulsifier and the time for the emulsification) and, thus, Sample Nos. 2 through 12 were obtained in the same manner as the formation of Sample No. 1. The compounds used were as follows:

Comparative Compound B (dielectric constant: 3.63)
Compound (S-7) (dielectric constant: 4.80)
Compound (S-9) (dielectric constant: 4.46)
Compound (S-16) (dielectric constant: 7.33)
Compound (S-25) (dielectric constant: 6.45)

Further, Sample Nos. 13 through 20 and Sample Nos. 21 through 28 were formed in the same manner as Sample Nos. 1 through 12 with the exception that Magenta Coupler (M-1) and Cyan Coupler (C-1) were used, respectively, in place of Yellow Coupler (Y-1). In the case of the use of the magenta coupler, the amount of the coated coupler was 0.37 g/m$^2$, and the Ag-coated amount of the silver chlorobromide emulsion (Br content: 75 mol %) was 0.20 g/m$^2$; and in the case of the use of the cyan coupler, the amount of the coated coupler was 0.33 g/m$^2$, and the Ag-coated amount of the silver chlorobromide emulsion (Br content: 70 mol %) was 0.28 g/m$^2$.

Yellow Coupler (Y-1)

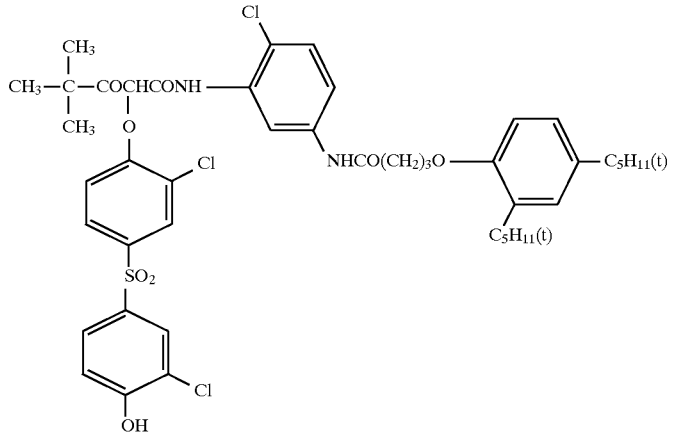

Magenta Coupler (M-1)

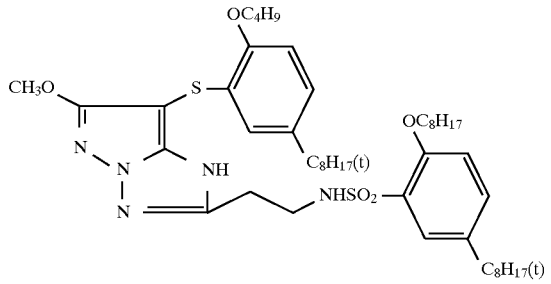

Cyan Coupler (C-1)

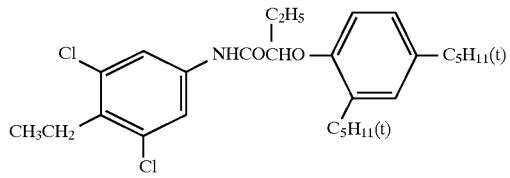

Comparative Compound A (dielectric constant: 3.61)

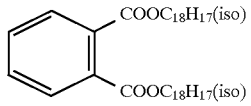

Comparative Compound B (dielectric constant: 3.63)

$O{=}P{\leftarrow}OC_{18}H_{35})_3$

These samples were subjected to gradation exposure for sensitometry and thereafter processed by the following Step (A) or (B), each using the following Color Developer (A) or (B), respectively. Steps (A) and (B) were the same with the differentiation of only the use of Color Developer (A) or (B) in each step.

The evaluation of the photographic properties was made on the two items of the maximum density (Dmax) and the minimum density (Dmin).

The results are given in Table 1.

| Processing Step | Temperature (°C.) | Time (min) |
|---|---|---|
| Development | 38 | 2.0 |
| Bleach-Fixing | 33 | 1.5 |
| Rinsing | 28–35 | 3.0 |

Composition of Developer:

Color Developer (A)

| | |
|---|---|
| 3Na.Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30.0 g |
| Water to make | 1,000 ml (pH 10.1) |

Color Developer (B):

| | |
|---|---|
| 3Na.Nitrilotriacetate | 2.0 g |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30.0 g |
| Water to make | 1,000 ml (pH 10.1) |

Composition of Bleach-Fixing Solution:

| | |
|---|---|
| Ammonium Thiosulfate (54 wt %) | 150 ml |
| $Na_2SO_3$ | 15 g |
| $NH_4$[Fe(III) (EDTA)] | 55 g |
| EDTA.2Na | 4 g |
| Water to make | 1,000 ml (pH 6.9) |

TABLE 1

| Sample No. | Coupler | High Boiling Organic Solvent | Average Grain Diameter of (μm) | Photographic Characteristics Step (A) Dmin | Step (A) Dmax | Step (B) Dmin | Step (B) Dmax | Remarks |
|---|---|---|---|---|---|---|---|---|
| 1 | (Y-1) | Comparative Compound A | 0.46 | 0.08 | 1.90 | 0.08 | 1.50 | Comparison |
| 2 | " | Comparative Compound A | 0.11 | 0.08 | 2.01 | 0.08 | 1.72 | " |
| 3 | " | Comparative Compound B | 0.53 | 0.08 | 1.89 | 0.08 | 1.45 | " |
| 4 | " | Comparative Compound B | 0.10 | 0.08 | 1.97 | 0.08 | 1.60 | " |
| 5 | " | (S-7) | 0.42 | 0.08 | 2.04 | 0.08 | 1.90 | " |
| 6 | " | (S-7) | 0.18 | 0.08 | 2.06 | 0.08 | 2.01 | Invention |
| 7 | " | (S-9) | 0.51 | 0.08 | 2.05 | 0.08 | 1.92 | Comparison |
| 8 | " | (S-9) | 0.10 | 0.08 | 2.07 | 0.08 | 2.03 | Invention |
| 9 | " | (S-16) | 0.39 | 0.09 | 2.10 | 0.08 | 1.99 | Comparison |
| 10 | " | (S-16) | 0.09 | 0.09 | 2.13 | 0.08 | 1.11 | Invention |
| 11 | " | (S-25) | 0.48 | 0.08 | 2.10 | 0.08 | 1.97 | Comparison |
| 12 | " | (S-25) | 0.12 | 0.08 | 2.14 | 0.08 | 2.11 | Invention |
| 13 | (M-1) | Comparative Compound B | 0.50 | 0.09 | 2.52 | 0.09 | 2.21 | Comparison |
| 14 | " | Comparative Compound B | 0.09 | 0.09 | 2.64 | 0.09 | 2.40 | " |
| 15 | " | (S-9) | 0.40 | 0.09 | 2.59 | 0.09 | 2.40 | " |
| 16 | " | (S-9) | 0.08 | 0.09 | 2.63 | 0.09 | 2.58 | Invention |
| 17 | " | (S-16) | 0.42 | 0.10 | 2.71 | 0.10 | 2.60 | Comparison |
| 18 | " | (S-16) | 0.11 | 0.10 | 2.77 | 0.10 | 2.73 | Invention |
| 19 | " | (S-25) | 0.48 | 0.09 | 2.66 | 0.09 | 2.48 | Comparison |
| 20 | " | (S-25) | 0.21 | 0.09 | 2.69 | 0.09 | 2.66 | Invention |
| 21 | (C-1) | Comparative Compound B | 0.40 | 0.11 | 2.59 | 0.10 | 2.20 | Comparison |
| 22 | " | Comparative Compound B | 0.08 | 0.11 | 2.64 | 0.10 | 2.35 | " |
| 23 | " | (S-9) | 0.38 | 0.10 | 2.68 | 0.10 | 2.51 | " |
| 24 | " | (S-9) | 0.09 | 0.10 | 2.74 | 0.10 | 2.67 | Invention |
| 25 | " | (S-16) | 0.50 | 0.11 | 2.74 | 0.10 | 2.56 | Comparison |
| 26 | " | (S-16) | 0.10 | 0.11 | 2.81 | 0.10 | 2.74 | Invention |
| 27 | " | (S-25) | 0.44 | 0.10 | 2.77 | 0.10 | 2.58 | Comparison |
| 28 | " | (S-25) | 0.12 | 0.10 | 2.79 | 0.10 | 2.72 | Invention |

Table 1 proves that the samples (Sample Nos. 6, 8, 10, 12, 16, 18, 20, 24, 26 and 28) of the present invention had sufficient maximum density both in Step (A) and in Step (B) in the use of any of the yellow, magenta and cyan couplers, while the decrease in color density was especially noticeable in the comparative samples (Sample Nos. 1 to 5, 7, 9, 11, 13 to 15, 17, 19, 21 to 23, 25 and 27) when processed in Step (B) with no benzyl alcohol.

EXAMPLE 2

A multilayer color photographic paper of the present invention was formed, having the layers as shown in the following Table 2, the layers being provided on a paper support laminated both sides thereof with polyethylene.

This light-sensitive material was designated as Sample (a).

The coating solutions were prepared as follows:

Preparation of the First Layer-Coating Solution:

27.2 ml of ethyl acetate and 7.9 ml of Solvent (c) were added to 19.1 g of Yellow Coupler (a) and 4.4 g of Color Image Stabilizer (b) and dissolved. The resulting solution was added to 185 ml of a 10% gelatin aqueous solution containing 16 ml of 10% sodium dodecylbenzenesulfonate and emulsified in a homogenizer to obtain an emulsified dispersion having a mean grain diameter of 0.15 $\mu$m. (The grain size was measured by the use of Nano-Sizer (by Coulter Electronics Ltd., England), which is a grain size measuring apparatus with laser ray-scattering.)

On the other hand, the following blue-sensitive sensitizing dye was added to a silver chlorobromide emulsion (silver bromide content: 80 mol %, silver content: 70 g/kg) in an amount of $7.0\times10^{-4}$ mol per mol of the silver chlorobromide to obtain 90 g of a blue-sensitive emulsion.

The emulsified dispersion and the emulsion were blended and dissolved, and the gelatin concentration was so regulared as shown in Table 2 to obtain a first layer-coating solution.

The other second layer- to seventh layer-coating solutions were prepared in the same manner as the first layer-coating solution.

Sodium 1-hydroxy-3,5-dichloro-s-triazine was used as the gelatin hardener in each layer.

The spectral sensitizer as used in each emulsion was as follows:

Blue-Sensitive Emulsion Layer:

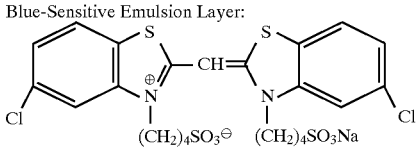

($7.0 \times 10^{-4}$ mol per mol of silver halide was added)

Green-Sensitive Emulsion Layer:

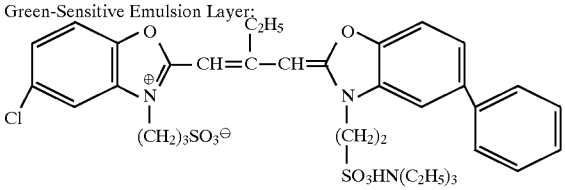

($4.0 \times 10^{-4}$ mol per mol of silver halide was added)

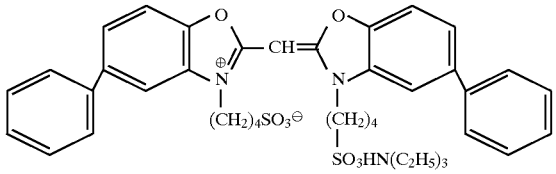

($7.0 \times 10^{-5}$ mol per mol of silver halide was added)

Red-Sensitive Emulsion Layer:

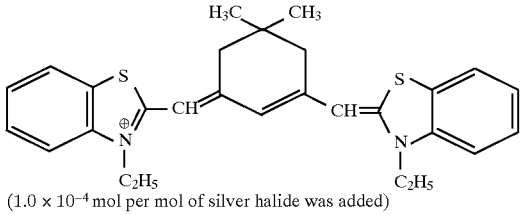

($1.0 \times 10^{-4}$ mol per mol of silver halide was added)

The anti-irradiation dye as used in each layer was as follows:

Green-Sensitive Emulsion Layer:

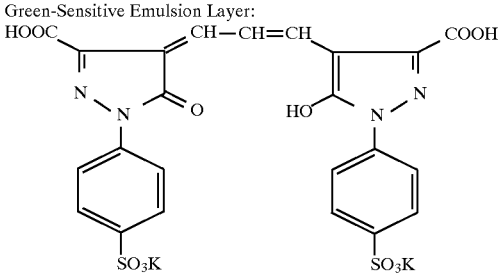

Red-Sensitive Emulsion Layer:

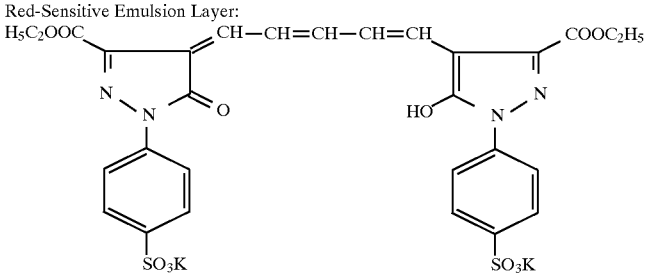

The couplers and other compounds as used in the present example have the following structural formulae:
(a) Yellow Coupler (Y-35):
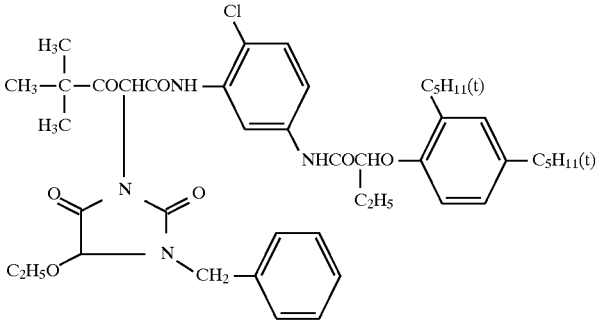
(b) Color Image Stabilizer:
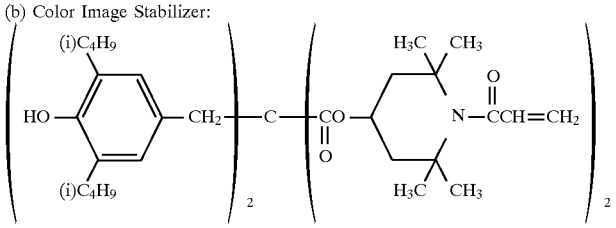
(c) Solvent:
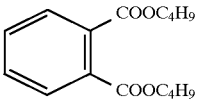
(d) Color Stain Preventing Agent:
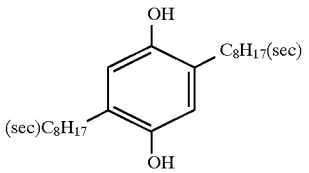
(e) Magenta Coupler (M-23):
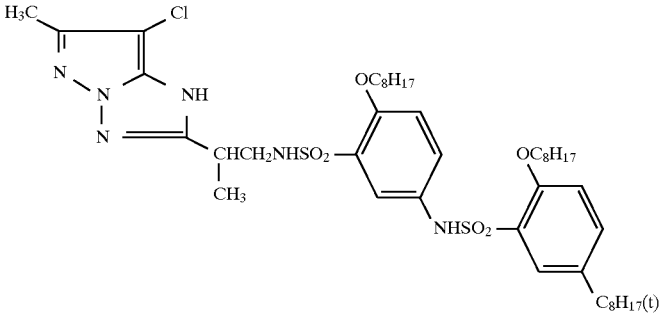
(f) Color Image Stabilizer:
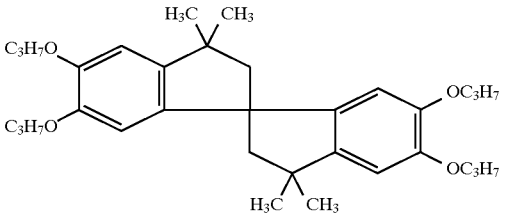
(g) Solvent:
Mixture (2/1 by weight) of $(C_8H_{17}O)_3P{=}O$ and
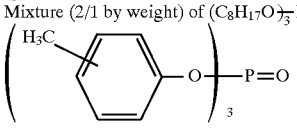
(h) Ultraviolet Absorbent:
Mixture (1/5/3 by molar ratio) of the following:
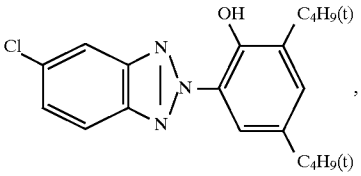

-continued

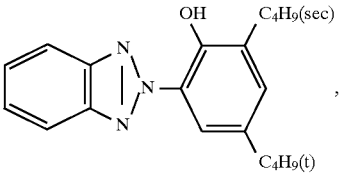

, and

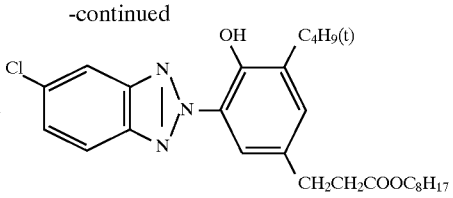

(i) Color Stain Preventing Agent:

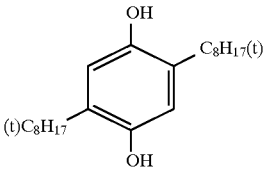

(j) Solvent:

$(iso\text{-}C_9H_{19}O)_3P{=}O$ (k) Cyan Coupler:

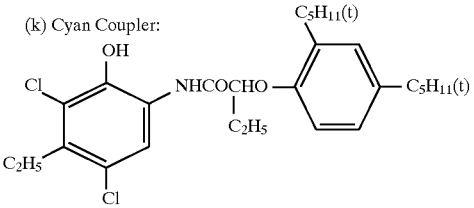

(l) Color Image Stabilizer:

Mixture (1/3/3 by molar ratio) of the following:

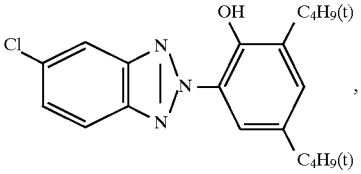

,

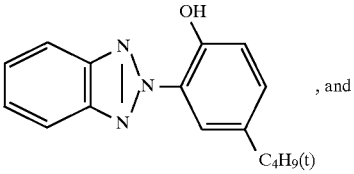

, and

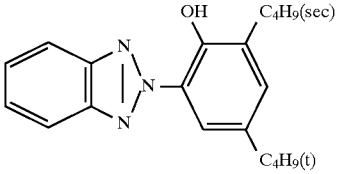

(m) Solvent: (S-16)

TABLE 2

| | |
|---|---|
| Seventh Layer: Protective Layer | |
| Gelatin | 1.33 g/m$^2$ |
| Acryl-modified polyvinyl alcohol copolymer (modification degree: 17%) | 0.17 g/m$^2$ |
| Sixth Layer: UV Absorbent Layer | |
| Gelatin | 0.54 g/m$^2$ |
| UV Absorbent (h) | 0.21 g/m$^2$ |
| Solvent (j) | 0.09 ml/m$^2$ |
| Fifth Layer: Red-Sensitive Layer | |
| Silver chlorobromide emulsion (silver bromide: 70 mol %) | Ag 0.26 g/m$^2$ |
| Gelatin | 0.98 g/m$^2$ |
| Cyan Coupler (k) | 0.34 g/m$^2$ |
| Color Image Stabilizer (l) | 0.17 g/m$^2$ |
| Solvent (m) | 0.23 ml/m$^2$ |
| Fourth Layer: UV Absorbent Layer | |
| Gelatin | 1.60 g/m$^2$ |
| UV Absorbent (h) | 0.62 g/m$^2$ |
| Color Stain Preventing Agent (i) | 0.05 g/m$^2$ |
| Solvent (j) | 0.26 ml/m$^2$ |

TABLE 2-continued

| | |
|---|---|
| Third Layer: Green-Sensitive Layer | |
| Silver chlorobromide emulsion (silver bromide: 75 mol %) | Ag 0.16 g/m$^2$ |
| Gelatin | 1.80 g/m$^2$ |
| Magenta Coupler (e) | 0.34 g/m$^2$ |
| Color Image Stabilizer (f) | 0.20 g/m$^2$ |
| Solvent (g) | 0.68 ml/m$^2$ |
| Second Layer: Color Stain Preventing Layer | |
| Gelatin | 0.99 g/m$^2$ |
| Color Stain Preventing Agent (d) | 0.08 g/m$^2$ |
| First Layer: Blue-Sensitive Layer | |
| Silver chlorobromide emulsion (silver bromide: 80 mol %) | Ag 0.30 g/m$^2$ |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |

Support:

Polyethylene laminated paper (containing white pigment of $TiO_2$ and bluish dye of ultramarine in the polyethylene on the side supporting the first layer)

Next, the following Photographic Light-Sensitive Material Samples (b) through (d) were formed.

Sample (b):

This was the same as Sample (a) with the exception that the mean grain sizes of the emulsified dispersions in each of the first, third and fifth layers were varied as shown in the following Table 3 by regulating the emulsification conditions of the dispersions.

Sample (c):

This was the same as Sample (a) with the exception that the solvents in the first, third and fifth layers were replaced by the same volume of Comparative Compound A.

Sample (d):

This was the same as Sample (c) with the exception that the mean grain sizes of the emulsified dispersions in each of the first, third and fifth layers were varied as shown in the following Table 3 by regulating the emulsification conditions of the dispersions.

These samples were subjected to gradation exposure for sensitometry through each of blue, green and red filters with a sensitometer (FWH type, made by Fuji Photo Film Co., Ltd., light source color temperature: 3,200° K). The exposure time was 0.5 second and the exposure amount was 250 CMS.

Afterwards, the thus exposed samples were processed by the following Step (A) or (B) with Color Developer (A) or (B), respectively, as shown below.

The photographic process comprised color development, bleach-fixing and rinsing; and the photographic characteristics of the samples were evaluated by varying the development 1 min, 2 min, and 3 min. Steps (A) and (B) were the same with the differentiation of only the use of Color Developer (A) or (B) in each step.

The evaluations of the photographic characteristics were made on four items of relative sensitivity, gradation, maximum density (Dmax) and minimum density (Dmin).

The relative sensitivity was represented by a relative value on the basis of the index value (100) of the sensitivity of each sample as processed by Step (A) where the color development time was 2 minutes. The sensitivity was designated by the relative value of the reciprocal of the exposure amount as required for obtaining the density comprising the minimum density plus 0.5.

The gradation was designated by the density difference between the sensitivity point and the point comprising the logarithm of exposure amount (logE) plus 0.5.

The results are given in Table 3.

| Processing Step | Temperature (°C.) | Time (min) |
|---|---|---|
| Development | 38 | 1.0–3.0 |
| Bleach-Fixing | 33 | 1.5 |
| Rinsing | 28–35 | 3.0 |

Composition of Developer:

Color Developer (A):

| | |
|---|---|
| 3Na.Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30.0 g |
| Water to make | 1,000 ml |
| | (pH 10.1) |

Color Developer (B):

| | |
|---|---|
| 3Na.Nitrilotriacetate | 2.0 g |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30.0 g |
| Water to make | 1,000 ml |
| | (pH 10.1) |

Composition of Bleach-Fixing Solution:

| | |
|---|---|
| Ammonium Thiosulfate (54 wt %) | 150 ml |
| $Na_2SO_3$ | 15 g |
| $NH_4$[Fe(III)(EDTA)] | 55 g |
| EDTA.2Na | 4 g |
| Water to make | 1,000 ml |
| | (pH 6.9) |

TABLE 3

| | | Mean Grain Size of Emulsified | Step (A) | | | | | | | | | | | |
|---|---|---|---|---|---|---|---|---|---|---|---|---|---|---|
| | * | Dispersion | Development Time: 1 Min. | | | | Development Time: 2 Min. | | | | Development Time: 3 Min. | | | |
| Sample | Layer | (μm) | 1 | 2 | Dmin | Dmax | 1 | 2 | Dmin | Dmax | 1 | 2 | Dmin | Dmax |
| (a) | B | 0.15 | 62 | 1.02 | 0.10 | 2.01 | 100 | 1.17 | 0.11 | 2.14 | 122 | 1.20 | 0.11 | 2.15 |
| Invention | G | 0.14 | 77 | 1.30 | 0.10 | 2.63 | 100 | 1.35 | 0.12 | 2.69 | 127 | 1.39 | 0.11 | 2.75 |
| | R | 0.16 | 78 | 1.40 | 0.11 | 2.81 | 100 | 1.46 | 0.11 | 2.83 | 133 | 1.50 | 0.12 | 2.85 |
| (b) | B | 0.30 | 59 | 0.99 | 0.10 | 1.98 | 100 | 1.02 | 0.10 | 2.04 | 118 | 1.10 | 0.12 | 2.07 |
| Comparison | G | 0.32 | 72 | 1.27 | 0.10 | 2.60 | 100 | 1.29 | 0.11 | 2.62 | 124 | 1.32 | 0.11 | 2.70 |
| | R | 0.29 | 76 | 1.38 | 0.10 | 2.78 | 100 | 1.40 | 0.11 | 2.81 | 127 | 1.42 | 0.11 | 2.82 |

TABLE 3-continued

| | | | | | | | | | | | | | | |
|---|---|---|---|---|---|---|---|---|---|---|---|---|---|---|
| (c) | B | 0.14 | 36 | 0.83 | 0.11 | 1.88 | 100 | 1.00 | 0.11 | 1.95 | 118 | 1.10 | 0.11 | 2.02 |
| Comparison | G | 0.16 | 57 | 1.16 | 0.10 | 2.46 | 100 | 1.23 | 0.10 | 2.51 | 125 | 1.26 | 0.11 | 2.54 |
| | R | 0.16 | 63 | 1.27 | 0.11 | 2.62 | 100 | 1.34 | 0.10 | 2.72 | 123 | 1.38 | 0.12 | 2.76 |
| (d) | B | 0.28 | 32 | 0.80 | 0.11 | 1.85 | 100 | 0.97 | 0.11 | 1.87 | 116 | 1.02 | 0.12 | 1.90 |
| Comparison | G | 0.34 | 51 | 1.06 | 0.10 | 2.37 | 100 | 1.00 | 0.10 | 2.41 | 124 | 1.09 | 0.12 | 2.45 |
| | R | 0.31 | 57 | 1.11 | 0.10 | 2.58 | 100 | 1.07 | 0.11 | 2.60 | 121 | 1.16 | 0.12 | 2.63 |

| | | Mean Grain Size of Emulsified | Step (B) | | | | | | | | | | | |
|---|---|---|---|---|---|---|---|---|---|---|---|---|---|---|
| | * | Dispersion | Development Time: 1 Min. | | | | Development Time: 2 Min. | | | | Development Time: 3 Min. | | | |
| Sample | Layer | (μm) | 1 | 2 | Dmin | Dmax | 1 | 2 | Dmin | Dmax | 1 | 2 | Dmin | Dmax |
| (a) | B | 0.15 | 63 | 1.02 | 0.10 | 2.00 | 94 | 1.13 | 0.10 | 2.10 | 114 | 1.20 | 0.11 | 2.17 |
| Invention | G | 0.14 | 83 | 1.30 | 0.10 | 2.61 | 98 | 1.31 | 0.11 | 2.68 | 122 | 1.38 | 0.10 | 2.76 |
| | R | 0.16 | 84 | 1.39 | 0.10 | 2.80 | 98 | 1.45 | 0.11 | 2.82 | 123 | 1.51 | 0.10 | 2.86 |
| (b) | B | 0.30 | 58 | 0.97 | 0.10 | 1.96 | 90 | 0.94 | 0.10 | 2.00 | 109 | 1.10 | 0.10 | 2.00 |
| Comparison | G | 0.32 | 76 | 1.25 | 0.10 | 2.57 | 90 | 1.21 | 0.10 | 2.58 | 115 | 1.27 | 0.10 | 2.64 |
| | R | 0.29 | 74 | 1.37 | 0.10 | 2.75 | 94 | 1.32 | 0.11 | 2.77 | 118 | 1.40 | 0.10 | 2.75 |
| (c) | B | 0.14 | 35 | 0.57 | 0.10 | 1.44 | 72 | 0.64 | 0.10 | 1.69 | 88 | 0.69 | 0.11 | 1.77 |
| Comparison | G | 0.16 | 47 | 0.69 | 0.09 | 1.84 | 73 | 0.78 | 0.10 | 1.96 | 89 | 0.72 | 0.11 | 2.09 |
| | R | 0.16 | 58 | 0.72 | 0.10 | 1.98 | 73 | 0.95 | 0.10 | 2.07 | 97 | 0.99 | 0.11 | 2.17 |
| (d) | B | 0.28 | 29 | 0.44 | 0.10 | 1.30 | 63 | 0.50 | 0.10 | 1.57 | 73 | 0.56 | 0.11 | 1.64 |
| Comparison | G | 0.34 | 39 | 0.58 | 0.10 | 1.70 | 72 | 0.64 | 0.11 | 1.83 | 84 | 0.69 | 0.12 | 1.92 |
| | R | 0.31 | 51 | 0.69 | 0.10 | 1.84 | 73 | 0.81 | 0.09 | 1.90 | 52 | 0.86 | 0.11 | 2.00 |

Note *B: first layer in Samples (a) to (d), G: third layer in Sample (a) to (d), R: fifth layer in Samples (a) to (d)
1: Relative Sensitivity
2: Gradation Table 3 proves that Photographic Light-Sensitive Material Sample (a) of the present invention is superior to the other Comparative Photographic Light-Sensitive Material Samples (b) through (d) in that the difference of the photographic property (including relative sensitivity, gradation and maximum density) is small in Process (A) and Process (B) and thus the same result as in Process (A) can be attained even by Process (B) with no benzyl alcohol.

In addition, good photographic properties could be obtained by the development with development time of 2 minutes in the present Sample (a).

EXAMPLE 3

Samples (e), (f), (g) and (h) were prepared in the same manner as described for Samples (a), (b), (c) and (d), respectively, except that silver halide emulsions used for the first layer (blue-sensitive layer), the third layer (green-sensitive layer), and the fifth layer (red-sensitive layer) were a silver chlorobromide emulsion (silver bromide: 1 mol %, cubic shape, mean grain size: 1.0 μm), a silver chlorobromide emulsion (silver bromide: 1.5 mol %, cubic shape, mean grain size: 0.4 μm), and a silver chlorobromide emulsion (silver bromide: 1.5 mol %, cubic shape, mean grain size: 0.5 μm), respectively.

These samples were exposed as in Example 2, and then processed by the following Step (C) or (D) with Color Developer (C) or (D), respectively, as shown below to obtain color images.

Steps (C) and (D) were the same with the differentiation of only the use of Color Developer (C) or (D) in each step.

The evaluations of the photographic characteristics were made on two items of maximum density (Dmax) and minimum density (Dmin).

The results are given in Table 4 below.

| Processing Step | Temperature (°C.) | Time (sec) |
|---|---|---|
| Development | 35 | 45 |
| Bleach-Fixing | 30–35 | 45 |
| Rinsing* (1) | " | 20 |
| " (2) | " | 20 |
| " (3) | " | 20 |
| " (4) | " | 30 |
| Drying | 70–80 | 60 |

| Composition of Developer: Color Developer (C): | |
|---|---|
| Ethylenediamine-N,N,N',N'-tetramethylenephosphonic Acid | 1.5 g |
| 1,4-Diazabicyclo[2,2,2]octane | 6.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| Fluorescent Brightener (4,4'-diaminostilbene type) | 2.0 g |
| Benzyl Alcohol | 10.0 ml |
| Water to make | 1,000 ml (pH 10.10) |

*: Four stage countercurrent flow system is applied in rinsing stage.

Color Developer (D):

This was the same as Color Developer (C) with the exception that benzyl alcohol is not contained.

| Composition of Bleach-Fixing Solution: | |
|---|---|
| Ammonium Thiosulfate (70 wt %) | 100 ml |
| $Na_2SO_3$ | 18 g |
| $NH_4$[Fe(III)(EDTA)] | 55 g |
| EDTA.2Na | 3 g |
| Ammonium Bromide | 40 g |
| Glacial Acetic Acid | 8 g |
| Water to make | 1,000 ml |
| | (pH 5.5) |

Rinsing Solution:

Demineralized water (containing not more than 3 ppm of calcium and magnesium, respectively).

TABLE 4

| Sample | Layer* | Mean Grain Size of Emulsified Dispersion (μm) | Step (C) D min | Step (C) D max | Step (D) D min | Step (D) D max | ΔD max |
|---|---|---|---|---|---|---|---|
| (e) | B | 0.11 | 0.10 | 2.21 | 0.10 | 2.18 | 0.03 |
| Invention | G | 0.12 | 0.10 | 2.81 | 0.10 | 2.75 | 0.06 |
| | R | 0.12 | 0.11 | 2.89 | 0.11 | 2.85 | 0.04 |
| (f) | B | 0.32 | 0.10 | 2.20 | 0.10 | 2.01 | 0.19 |
| Comparison | G | 0.32 | 0.10 | 2.79 | 0.10 | 2.60 | 0.19 |
| | R | 0.31 | 0.12 | 2.87 | 0.11 | 2.70 | 0.17 |
| (g) | B | 0.12 | 0.10 | 2.10 | 0.10 | 1.80 | 0.30 |
| Comparison | G | 0.13 | 0.11 | 2.72 | 0.10 | 2.51 | 0.21 |
| | R | 0.14 | 0.11 | 2.84 | 0.11 | 2.62 | 0.22 |
| (h) | B | 0.32 | 0.10 | 2.09 | 0.10 | 1.73 | 0.36 |
| Comparison | G | 0.34 | 0.11 | 2.71 | 0.10 | 2.46 | 0.25 |
| | R | 0.32 | 0.12 | 2.82 | 0.10 | 2.53 | 0.29 |

Note *:
B: first layer in Samples (e) to (h)
G: third layer in Samples (e) to (h)
R: fifth layer in Samples (e) to (h)

Table 4 proves that the Photographic Light-Sensitive Sensitive Material Sample (e) of the present invention is superior to the other Comparative Photographic Light-Sensitive Material Samples (f) through (h) in that the coloring property is high and the difference of the photographic property of Step (C) and that of Step (D) is small.

In addition, a good photographic property could be obtained by the development with development time of short period and no benzyl alcohol in the present Sample (e).

While the invention has been described in detail and with reference to specific embodiments thereof, it will be apparent to one skilled in the art that various changes and modifications can be made therein without departing from the spirit and scope thereof.

What is claimed is:

1. A process for the formation of color images comprising:

image-wise exposing a silver halide color photographic material, said photographic material having on a reflective support a silver halide emulsion layer containing a dispersion of oleophilic fine grains having a mean grain size of 0.25 μm to 0.05 μm, which dispersion contains a pyrazolo[5,1-c][1,2,4]triazole or pyrazolo[1,5-b][1,2,4]triazole coupler capable of forming a magenta dye after having been coupled with an oxidation product of an aromatic primary amine developing agent and at least one high boiling organic solvent having a dielectric constant of 5.0 or more (25° C., 10 KHz) and having the formula (I):

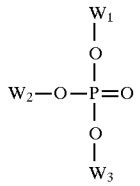

(I)

wherein $W_1$, $W_2$ and $W_3$ each represents an alkyl, cycloalkyl, alkenyl or aryl group;

then subjecting the image-wise exposed photographic material to development at a processing temperature of 33° to 45° C. with a color developer which contains an aromatic primary amine developing agent and 0.5 ml/l or less of benzyl alcohol, for a period of time within 2 minutes or less.

2. A process for the formation of color images as claimed in claim 1, wherein $W_1$, $W_2$ and $W_3$ each represents an unsubstituted alkyl, cycloalkyl, alkenyl or aryl.

3. A process for the formation of color images as claimed in claim 1, wherein $W_1$, $W_2$ and $W_3$ each represents an alkyl group, a cycloalkyl group, an alkenyl group or an aryl group wherein said group is unsubstituted or is substituted by one or more substituents having one or more linking groups selected from the group consisting of —COO—, —CON<, —$R^8$N<, and —O—, where $R^8$ represents a divalent group obtained by removal of hydrogen atom(s) from a phenyl group.

4. A process for the formation of color images as claimed in claim 1, wherein $W_1$, $W_2$, and $W_3$ each represents a linear or branched alkyl group optionally substituted by one or more substituents selected from a halogen atom, a cycloalkyl group, an aryl group, or an ester group.

5. A process for the formation of color images as claimed in claim 1, wherein the color developer contains no benzyl alcohol.

6. A process for the formation of color images as claimed in claim 1, wherein the color development time is 1 to 2 minutes.

7. A process for the formation of color images as claimed in claim 1, wherein the color developer is an alkaline aqueous solution comprising the aromatic primary amine developing agent.

8. A process for the formation of color images as claimed in claim 1, wherein said silver halide emulsion layer contains silver halide grains having a cubic or tetradecahedral crystal form.

9. A process for the formation of color images as claimed in claim 1, wherein said silver halide emulsion layer contains a silver halide emulsion having a coefficient of variation of 20% or less.

10. A process for the formation of color images as claimed in claim 9, wherein the coefficient of variation is 15% or less.

11. A process for the formation of color images as claimed in claim 1, wherein the silver halide emulsion layer contains a silver halide emulsion which essentially forms a latent image on the surface thereof upon exposure to light.

12. A process for the formation of color images as claimed in claim 1, wherein the aromatic primary amine developing agent is 3-methyl-4-amino-N-ethyl-N-β-hydroxyethylaniline or 3-methyl-4-amino-N-ethyl-N-β-methanesulfonamidoethylaniline.

13. A process for the formation of color images as claimed in claim 1, wherein the aromatic primary amine developing agent is 3-methyl-4-amino-N-ethyl-N-β-methanesulonamidoethylaniline.

14. A process for the formation of color images as claimed in claim 1, wherein the ratio by weight of the high boiling organic solvent to the coupler is from 0.05/1 to 20/1.

15. The process as claimed in claim 14, wherein the processing time is about one minute.

16. The process as claimed in claim 1, wherein the processing time is about one minute.

17. A process for the formation of color images comprising:

image-wise exposing a silver halide color photographic material, said photographic material having on a reflective support a silver halide emulsion layer containing a dispersion of oleophilic fine grains having a mean grain size of 0.25 μm to 0.05 μm, which dispersion contains a pyrazolo[5,1-c][1,2,4]triazole or pyrazolo[1,5-b][1,2,4]triazole coupler capable of forming a magenta dye after having been coupled with an oxidation product of an aromatic primary amine developing agent and at least one high boiling organic solvent having a dielectric constant of 5.0 or more (25° C., 10 KHz) and having the formula (I):

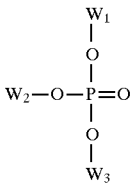

(I)

wherein $W_1$, $W_2$ and $W_3$ each represents: an unsubstituted alkyl; an unsubstituted cycloalkyl; an unsubstituted alkenyl; an unsubstituted aryl;

a halogen-substituted alkyl selected from $—C_2HF_4$, $—C_5H_3F_8$, $—C_9H_3F_{16}$, $—C_2H_4Cl$, $C_3H_6Cl$, $—C_3H_5Cl_2$, $—C_3H_5ClBr$, and $—C_3H_5Br_2$;

a cycloalkyl-substituted alkyl which is

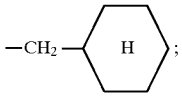

an aryl-substituted alkyl selected from

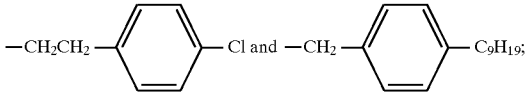

an ester-substituted alkyl selected from

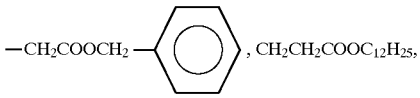

$—(CH_2)_4COOCH_2(CF_2CF_2)_2H$, $—(CH_2)_7COOC_4H_9$,

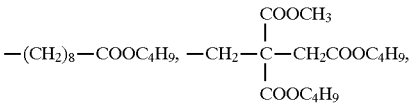

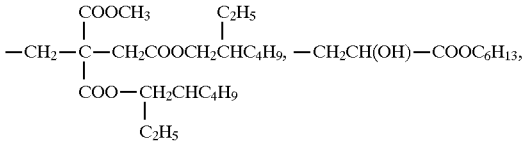

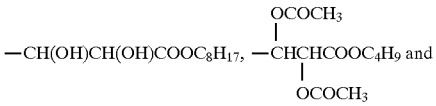

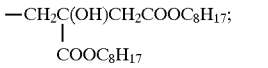

a substituted cycloalkyl selected from

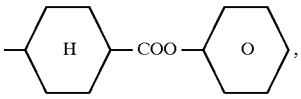

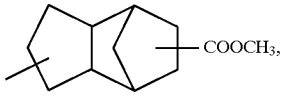

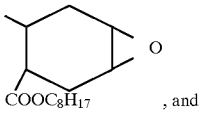

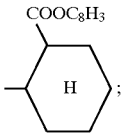

a substituted aryl selected from

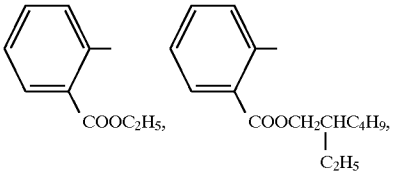

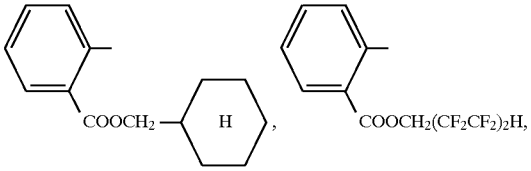

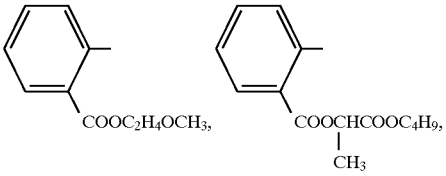

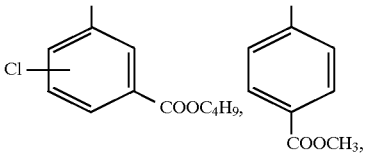

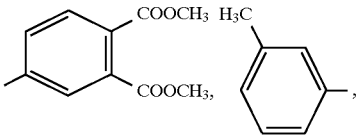

-continued

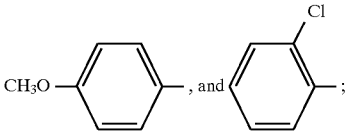

a substituted alkenyl wherein the substituent is a halogen atom, $—OC_8H_{17}$,

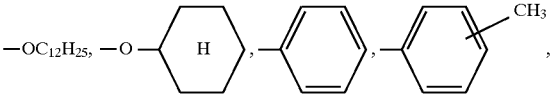

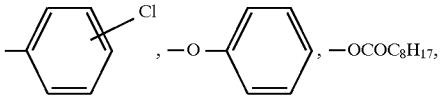

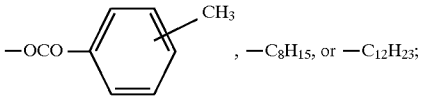

or a substituted ethenyl wherein the substituent is selected from

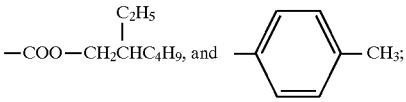

then subjecting the image-wise exposed photographic material to development at a processing temperature of 33° to 45° C. with a color developer which contains an aromatic primary amine developing agent and 0.5 ml/l or less of benzyl alcohol, for a color development step processing time within 2 minutes or less.

18. The process as claimed in claim 17, wherein the processing time is about one minute.

* * * * *